United States Patent [19]

Itoh et al.

[11] Patent Number: 4,845,020

[45] Date of Patent: Jul. 4, 1989

[54] METHOD OF PROCESSING SILVER HALIDE PHOTOGRAPHIC MATERIAL USING AN ORGANIC COMPOUND WHICH LOSES ITS DEVELOPMENT RESTRAINING FUNCTION BY REACTION WITH AN OXIDIZED DEVELOPER

[75] Inventors: Isamu Itoh; Keiji Mihayashi, both of Kanagawa, Japan

[73] Assignee: Fuji Photo Film Co., Ltd., Kanagawa, Japan

[21] Appl. No.: 77,545

[22] Filed: Jul. 24, 1987

Related U.S. Application Data

[63] Continuation of Ser. No. 785,687, Oct. 9, 1985, abandoned.

[30] Foreign Application Priority Data

Oct. 9, 1984 [JP] Japan ..... 59-212247

[51] Int. Cl.[4] ..... G03C 5/24; G03C 1/00; G03C 1/06

[52] U.S. Cl. ..... 430/445; 430/219; 430/382; 430/446; 430/489; 430/544; 430/598; 430/600; 430/611; 430/957; 430/960

[58] Field of Search ..... 430/445, 446, 489, 611, 430/600, 598, 957, 219, 960, 382, 544

[56] References Cited

U.S. PATENT DOCUMENTS

| | | | |
|---|---|---|---|
| 4,310,622 | 1/1982 | Onda et al. | 430/446 X |
| 4,328,302 | 5/1982 | Nishimura et al. | 430/446 X |
| 4,390,613 | 1/1983 | Mehta et al. | 430/445 X |
| 4,451,555 | 5/1984 | Pollet et al. | 430/446 X |
| 4,459,351 | 7/1984 | Adin et al. | 430/445 |

*Primary Examiner*—Mukund J. Shah

*Attorney, Agent, or Firm*—Sughrue, Mion, Zinn, Macpeak, and Seas

[57] ABSTRACT

A method of processing a silver halide photographic material comprising processing the silver halide photographic material in the presence of an antifoggant which is an organic compound which loses its developing restraining function by a reduction oxidation reaction with oxidized developers. The method improves the discrimination between image and non-image areas of the silver halide photographic material by the novel antifoggant which restrains fog selectively in non-image areas without decreasing photographic sensitivity and image density. The organic compound can be an antifoggant which possesses a moiety according to the Kendall-Pelz rule and either a mercapto group or a cyclic NH group.

11 Claims, No Drawings

METHOD OF PROCESSING SILVER HALIDE PHOTOGRAPHIC MATERIAL USING AN ORGANIC COMPOUND WHICH LOSES ITS DEVELOPMENT RESTRAINING FUNCTION BY REACTION WITH AN OXIDIZED DEVELOPER

This is a continuation of application Ser. No. 06/785,687, filed Oct. 9, 1985, now abandoned.

FIELD OF THE INVENTION

The present invention relates to a method of processing a silver halide photographic material and, in more detail, to a method of processing a silver halide photographic material in the presence of a novel anti-foggant and, more particularly, to a method of processing capable of improving discrimination by inhibiting fog selectively in non-image areas.

BACKGROUND OF THE INVENTION

Silver halide photographic materials form images by development processing after imagewise exposure. In black-and-white photographic materials such as direct medical X-ray films, black-and-white films for general photographing, litho films, scanner films or black-and-white photographic papers, silver halide grains in exposed areas are reduced by reducing agents such as hydroquinones, phenidones or aminophenols to form a silver image. In color photographic materials based on color development process an oxidation reduction reaction occurs between silver halide in exposed areas and color developers exemplified by p-phenylenediamines and the oxidized color developers couple with photographic couplers to form a color image. In color diffusion transfer photographic materials, a method of forming a positive image is known wherein direct positive silver halide emulsion designed to be developable only in non-image areas is associated with diffusible dye releasers (DRR compounds) releasing diffusible dyes upon reaction between the oxidized DRR and hydroxy anions.

The above mentioned silver halide black-and-white and color photographic materials have an important problem in common, that is, to restrain fog in non-image areas or, in other words, to improve discrimination between an image and background fog.

The term "discrimination" as used herein is intended to mean the distinction between fog in non-image areas and in image areas. This term is explained in the following literature:

(1) P. J. Hillson, "Discrimination and Development—The Influence of Excess Energy of Small Development Centers on the Kinetics of Development", *Journal of Photographic Science,* Vol. 22, page 31 (1974).

(2) P. J. Hillson, "Discrimination in Photographic Development", *Photographic Science and Engineering,* Vol. 23, page 40 (1979).

Latent image nuclei are formed by exposing negative silver halide emulsions to light. The subsequent development renders the latent image nuclei available as starting points of the development to form silver images as well as imagewise distribution of oxidized developers. Color development forms a dye image upon the coupling reaction between the oxidized developer and image forming couplers. Silver halide grains in non-exposed or non-image areas should not be reactive at all during development but are in practice partially developed and, therefore, fog is produced due to undesirably developed silver in black-and-white development while color stain as well as the above mentioned silver fog are generated in color development. Such undesirable phenomena are speculated to occur by various mechanisms: silver halide grains have developable fog nuclei already at the emulsion preparation stage; fog nuclei are formed by the influence of heat, humidity, pressure or harmful gas during storage of photographic films or papers; fog nuclei are generated by developing agents during development. Such fog formation due to the above mechanisms becomes a barrier to increasing photographic speed of modern silver halide photographic materials. In particular, p-phenylenediamine derivatives as primary color developers have the defect that they are apt to cause fog in spite of their comparatively low reactivity among developers and this becomes a restriction to accelerating development processing or to increasing photographic speed.

Therefore, the development of techniques to remove or to decrease fog is an important subject in the art, and the use of various antifoggants has been proposed. Examples of effective antifoggants include benzimidazoles having a nitro group, indazoles, nitrogen-containing heterocyclic compounds having a mercapto group (e.g., mercaptotetrazoles, mercaptooxazoles, mercaptothiazoles, mercaptotriazoles or benzotriazoles as disclosed in T. H. James, *The Theory of the Photographic Process,* 4th Ed., Macmillan (1977), pp. 396–399).

Further, low molecular weight antifoggants and polymer antifoggants are described in U.S. Pat. Nos. 3,157,509, 3,295,976, 3,342,596, 3,536,489, 3,576,638, 3,597,199, 3,598,599, 3,598,600 and 3,741,765, Japanese Patent Publication Nos. 6147/71, 19039/71, 4417/72, 10692/74, 41056/76 and 27933/78 and Japanese Patent Application (OPI) Nos. 18539/72, 43923/75 and 59463/80 (the term "OPI" as used herein refers to a "published unexamined Japanese patent application"). However, these antifoggants are unsatisfactory because the development in image areas as well as fog in non-image areas is restrained to such an extent that the image density greatly decreases, or because the sensitivity of the silver halide emulsion is lowered due to absorption of an antifoggant to silver halide grains at the exposure stage. Recently, U.S. Pat. Nos. 3,649,267, 3,888,677, 4,307,175, 4,310,612 and 4,350,752, Japanese Patent Publication Nos. 39727/79, 9696/80, 76541/82, 136640/82, 1140/83, 93442/84 and 105640/84 disclose a method of preventing sensitivity decrease of silver halide emulsions in which an antifoggant precursor is added to a photographic material and an antifoggant is rendered utilizable during development. The addition of such an antifoggant precursor seems to solve one of the problems caused by direct addition of an antifoggant but leaves the deterioration of discrimination unsolved owing to decrease of image density which arises from the restrained development in image areas. The greatest problem of the aforementioned prior art is caused by the fact that an antifoggant is present uniformly not only in non-image areas but also in image areas and thereby restrains fog generation in non-image areas and necessary image development as well. This problem has been substantial.

SUMMARY OF THE INVENTION

The first object of the present invention is to provide a method of processing a silver halide photographic material which improves the discrimination between image and non-image areas by development of a novel antifogging technology which substantially solves the problems of conventional technology.

The second object of the present invention is to provide a method of processing silver halide photographic material which restrains fog selectively without decreasing sensitivity and image density.

The third object of the present invention is to provide a high sensitivity silver halide photographic material of decreased fog and a method of processing such a photographic material.

The fourth object of the present invention is to provide a silver halide photographic material providing a uniform and stable photographic image under different storage conditions and a method of processing such a photographic material.

These and other objects of the present invention are attained by a method of processing a silver halide photographic material comprising processing said silver halide photographic material in the presence of an organic compound which substantially loses its development restraining function by reduction oxidation reaction with oxidized developers. The term "redox" as used hereafter refers to "reduction oxidation".

DETAILED DESCRIPTION OF THE INVENTION

The organic compounds according to the present invention include an antifoggant which substantially loses its development restraining function in its oxidized form converted by the redox reaction with oxidized developers because decreased function to be adsorbed on silver halide grains or lowered function to form silver salt results. This type of antifoggant possesses a moiety according to the Kendall-Pelz rule and a moiety of either an SH group or a cyclic —NH— group as well, and loses its function to be adsorbed on silver halide grains, when converted to an oxidized form by a redox reaction with oxidized developers and thereby loses its development restraining function as an antifoggant.

The Kendall-Pelz rule systemizes empirical relations between structural factors of organic compounds and reducing function. Compounds comprising a moiety in accordance with the Kendall-Pelz rule are known to possess reducing function and this rule has been supported recently by theoretical calculations based on the Hückel molecular orbital theory. The Kendal-Pelz rule (the term "KP rule" as used hereafter) is described in detail in literature such as T. H. James, *The Theory of the Photographic Process,* 4th Ed., cited above, pages 298–327. On the other hand, it has long been known that compounds having either an —SH group or a cyclic —NH— group have the function to be adsorbed on silver halide grains and, therefore, have the function to restrain development or inhibit fog, as described in the documents and patents specified above.

When development is carried out in the presence of a novel antifoggant according to the present invention, developers reduce silver halide grains in image areas and are themselves oxidized. These oxidized developers undergo redox reactions with the antifoggants of the present invention, which in turn are oxidized. The resulting oxidized antifoggant loses developing restraining function by at least one of the following mechanisms:

(1) An —SH or cyclic —NH— group acting as an adsorbing moiety onto silver halide grains reacts with the oxidized moiety and is converted to a group that has no function of adsorbing onto silver halide grains and finally loses its development inhibiting function.

(2) The oxidized antifoggant is subjected to the attack of components in the developing solution, in particular, such as sulfite ions to introduce a sulfo group and the introduction of the sulfo group leads to a substantial increase of hydrophilicity of the whole molecule and the loss of adsorbing function leads to disappearance of the development inhibiting function.

(3) The oxidized antifoggant is subjected to hydrolysis by the action of components in the developing solution, in particular, by hydroxy anions, and the adsorbing moiety increases its hydrophilicity and finally loses its developing restraining function. Therefore, the antifoggant does not exert its development restraining function in image areas.

On the other hand, in non-image areas where oxidized developer is not present, the antifoggant of the present invention is not converted into an oxidized form. Therefore, any of the above mentioned mechanisms (1), (2) and (3) does not operate and the antifoggant maintains the function to be adsorbed on silver halide grains and exerts its intrinsic function.

It will be understood that the processing in the presence of a novel antifoggant of the present invention shows unexpected results characterized in that the antifoggant provides reduced fog in non-image areas without deteriorating maximum density or sensitivity in image areas.

The novel antifoggant of the present invention has a distinctive feature that the antifoggant shows a development restraining function due to the adsorbing function onto silver halide grains during developing but that the antifoggant in image areas loses its development restraining function due to disappearance of the original function to be adsorbed on silver halide grains in image areas. With antifoggants having a moiety according to the KP rule, the presence of oxidized developer leads to initiation of an intramolecular reaction or of a reaction with a component in the developing solution and thereafter such a reaction leads to the disappearance of the function to be adsorbed on silver halide grains and of the function to restrain development.

Oxidation of a compound according to the KP rule generally leads to formation of a new double bond (e.g., $=C=O$, $=C=\oplus N=$, $=C=C=$) which makes the electronic states greatly different from the reduced form and, therefore, changes its chemical reactivity. In more detail, a newly formed electrophilic site undergoes a nucleophilic addition reaction with a nucleophilic agent which is present within the molecule or in the developing solution. In another case a newly formed electron attractive group easily leads to cleavage of the bond by the attack of components in the developing solution, in particular, by hydroxy ions. The aforementioned mechanisms of (1), (2) and (3) are based on the difference in the chemical reactivities between reduced and oxidized forms of the compound or on the difference in the affinity to silver halide grains or to silver ions of the compound.

The novel antifoggant of the present invention is preferably represented by formula (I):

$$a_1\text{-}\left(\underset{\underset{(Y_1)_{m1}}{|}}{C}=Z_1\right)_{n1}\text{-}b_1 \qquad \text{(I)}$$

wherein $a_1$ and $b_1$ each represents a hydroxy group, a group which provides a hydroxy group upon hydrolysis or a substituted or unsubstituted amino group ($Y_1$ can be a substituent of the amino group). $Z_1$ represents $$=\underset{\underset{R_1}{|}}{C}-$$

or =N—, in which $R_1$ represents a hydrogen atom or a substituent. The suffix $n_1$ represents an integer of 0 to 5. $Y_1$ represents a group having at least one substituent selected from the group consisting of a mercapto group and a cyclic amino group in which the nitrogen is unsubstituted. The suffix $m_1$ represents 0 or 1, and when $m_1$ represents 0, the carbon atom to which $Y_1$ is bonded may have another substituent. When $n_1$ represents 0, at least one of $a_1$ and $b_1$ represents an amino group substituted with $Y_1$, and when $m_1$ represents 0, at least one of $a_1$ and $b_1$ represents an amino group substituted with $Y_1$. When $n_1$ is 1 and $m_1$ is 0, at least one of $a_1$ and $b_1$ represents an amino group substituted with $Y_1$. When $n_1$ represents an integer of 2 to 5, the repeating unit $$\left(\underset{\underset{(Y_1)_{m1}}{|}}{C}=Z_1\right)$$

may be the same or different, and may form a single ring or condensed ring, and contain at least one $Y_1$ in the repeating units, or when $Y_1$ is not present in the whole repeating units, at least one of $a_1$ and $b_1$ represents an amino group substituted with $Y_1$.

Preferable examples of groups which provide a hydroxy group upon hydrolysis for $a_1$ or $b_1$ include an acyloxy group, a carbamoyloxy group, a sulfamoyloxy group, a carbonic ester group, a sulfonic acid ester group, an imidomethyloxy group, a phthalidoxy group, a 4-hydroxybenzyloxy group and cyclic groups such as a lactone ring, an oxazolone ring and an oxazolidinedione ring. When $a_1$ and $b_1$ represent a substituted amino group, preferable substituent groups include, besides the same groups that $Y_1$ represents, an alkyl group, an aryl group, an acyl group, a sulfonyl group, an oxycarbonyl group, a carbamoyl group, a sulfamoyl group, a hydroxy group and a heterocyclic group, and can be such groups that provide an —NH— group upon hydrolysis, and the number of the substituents of the respective groups is preferably 1. These substituents other than a hydroxyl group may be further substituted by any of an alkyl group, an aryl group, a halogen atom, an amino group, a carbonamido group, a sulfonamido group, a ureido group, a sulfamoylamino group, a carbamate group, an acyl group, a sulfonyl group, a carbamoyl group, a sulfamoyl group, an alkoxyl group, an aryloxy group, an oxycarbonyl group, a carboxy group, a sulfo group, a hydroxyl group, a cyano group, a nitro group, and a heterocyclic group. $R_1$ preferably represents a hydrogen atom, a halogen atom, an alkyl group, an aryl group, an amino group, a carbonamido group, a sulfonamido group, a ureido group, a sulfamoylamino group, a carbamate group, an alkoxyl group, an aryloxy group, an oxycarbonyl group, a carboxyl group, an acyl group, a sulfonyl group, a carbamoyl group, a sulfamoyl group, a hydroxyl group, a sulfo group, a cyano group, a nitro group, and a heterocyclic group and these substituents may be further substituted.

The moieties in accordance with the KP rule are described in *The Theory of the Photographic Process*, 4th Ed., cited above, in detail, and representative examples include moieties derived from a compound selected from the group consisting of hydroxylamines ($n_1=0$ in formula (I)), catechols, o-aminophenols, o-phenylenediamines, 2-amino-1-naphthols, ascorbic acids, 1,2-dihydroxynaphthols, α-ketols, α-aminoketones (all of these, $n_1=1$, $Z_1$ represents $$=\underset{\underset{R_1}{|}}{C}-$$

in formula (I)); hydroquinones, p-aminophenols, p-phenylenediamines, 1,4-dihydroxynaphthalenes, 4-amino-1-naphthols ($n_1=2$, $Z_1$ represents $$=\underset{\underset{R_1}{|}}{C}-$$

in general formula (I)); 4,4'-dihydroxybiphenyl ($n_1=1$, $Z_1$ represents $$=\underset{\underset{R_1}{|}}{C}-$$

in formula (I)); 5-amino-1-naphthols, 1,5-dihydroxynaphthalenes ($n_1=5$, $Z_1$ represents $$=\underset{\underset{R_1}{|}}{C}-$$

in formula (I)); 3-pyrazolidones, 3-amino-2-pyrazolines ($n_1=1$, $Z_1$ represents =N— in formula (I)).

Among these moieties, particularly preferable are catechols, O-aminophenols, hydroquinones, p-aminophenols, 1,4-dihydroxynaphthalenes and 4-amino-1-naphthols.

$Y_1$ is preferably represented by formula (II) or (III):

(II)

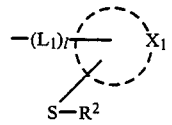

(III)

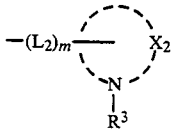

wherein $L_1$ and $L_2$ each represents a linking group; l and m each represents an integer of 0 to 2; $X_1$ and $X_2$ each represents a non-metallic atomic group necessary for forming a 4-membered to 7-membered ring and one or more other rings may be condensed further to the ring above and $L_1$ and $L_2$ can be connected to the condensed ring or rings; $R_2$ and $R_3$ represent a hydrogen atom or a group capable of becoming a hydrogen atom under an alkaline condition.

$L_1$ and $L_2$ represent preferably an alkylene group, an arylene group, a cycloalkylene group, an amino group, an acylamino group, a ureido group, a sulfamoylamino group, a carbamate group, a carbonic acid ester, an oxy group, an oxycarbonyl group, an acyl group, a thio group, a sulfonyl group, a sulfinyl group, an imino group, a heterocyclic group and any linking group formed by combination of these groups. When l or m represents 2, the free linking bond of $L_1$ or $L_2$ can be connected to the same or different ring and it means that two moieites in accordance with KP rule are present within the molecule. $R_2$ and $R_3$ represent independently a group capable of being hydrolyzed or removed by $\beta$-elimination and can be any group described in the patents identified above in relation to the antifoggant precursors. Represenatative examples include an acyl group, a carbamoyl group, a sulfamoyl group, an oxycarbonyl group, a 2-sulfonylethyl group, a 2-cyanoethyl group, an imidomethyl group, a 4-hydroxybenzyl group, an acyloxymethyl group, a 3-acethylpropionyl group, a hydantoin-5-yl-methyl group, a 3-carboxypropionyl group, a phthalido group, etc. The $-SR_2$ group or $=N-R_3$ group in formulae (II) and (III) can be connected at any position and, preferably, the sulfur atom or the nitrogen atom of these groups are located at particular positions wherein either of the sulfur atom or the nitrogen atom is capable of forming a 5-membered to 7-membered ring together with either carbon atom of $-C=C-$ group in accordance with the KP rule in formula (I). Further, when $L_1$ and $L_2$ each represents an electrophilic group capable of being cleft by the attack of a nucleophilic agent, it is preferable that the sulfur atom or the nitrogen atom is located at a position wherein either of the sulfur atom or the nitrogen atom is capable of forming a 5-membered to 7-membered cyclic reaction intermediate together with the electrophilic center atom of an electrophilic group.

Generally, an intramolecular reaction gives a rate constant $10^6$ times larger than an average intermolecular reaction does, as described in J. E. C. Hutchins and T. H. Fife, *J. Am. Chem. Soc.*, Vol. 95, page 3786 (1973) and Seiji Shinkai, *Gendaikagaku*, the May 1979 Issue, page 42.

The antifoggant of the present invention is characterized in that, in image areas, oxidation of a moiety according to the KP rule followed by a reaction with a nucleophilic agent (e.g., hydroxy ions, sulfite ions) present within the molecule or in a processing liquid leads to loss of the function to be adsorbed on silver halide grains and therefore to reduced development inhibition. Particularly suitable antifoggants are such compounds that lose adsorbing function by an intramolecular reaction which is very rapid in comparison with an intramolecular reaction. In a mechanism in which an intramolecular reaction deactivates an adsorbing function, it is preferable that oxidation of the moiety according to the KP rule leads to formation of a double bond and the adsorption center of a mercapto group or an unsubstituted cyclic amino group present within the molecule or generated by a deblocking reaction undergoes a 1,2- or 1,4-addition reaction with the double bond thus formed, and said mercapto group or unsubstituted cyclic amino group are, respectively, converted into a thioether or substituted amino group to lose adsorbing function.

In an alternative mechanism, oxidation of a moiety according to the KP rule changes its original electron donating tendency into an electron attractive one, and the electrophilic group present in $L_1$ or $L_2$ becomes more susceptible to a nucleophilic attack, and a mercapto group or cyclic unsubstituted amino group present within the molecule or generated by a deblocking reaction immediately attacks in a nucleophilic fashion to cause cleavage of bonds and these groups are converted into a thioether group or a substituted amino group, respectively, to lose an adsorbing function.

In non-image areas, however, a moiety according to the KP rule is not subjected to oxidation and, therefore, exhibits its intrinsic antifogging function to reduce fog. Decreases of image density or sensitivity is not observed, and fog in non-image areas is highly selectively restrained to provide a photographic image of improved discrimination.

The following are specific examples of the novel antifoggants shown only for illustrative purpose but not for limitation.

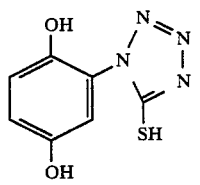
(1)

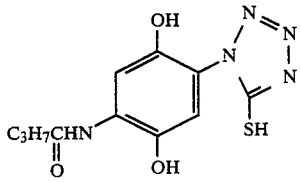
(2)

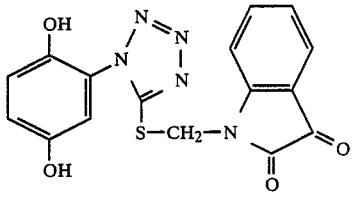
(3)

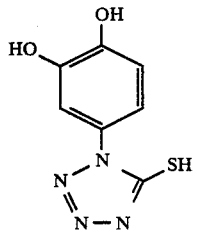
(4)

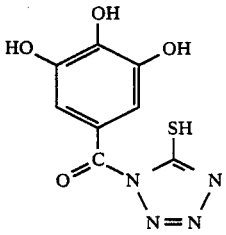
(5)

-continued
(6)
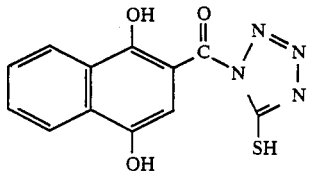
(7)
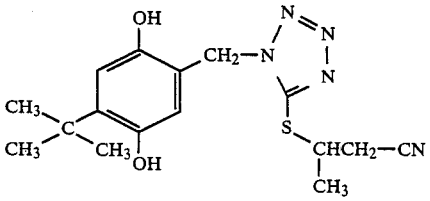
(8)
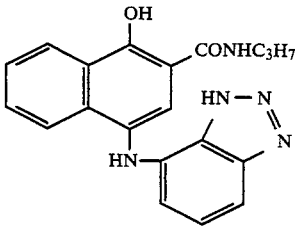
(9)
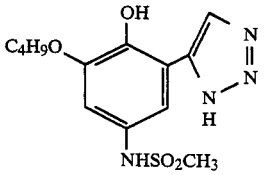
(10)
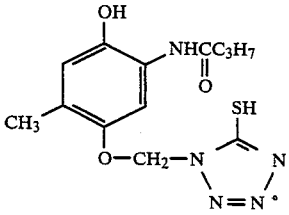
(11)
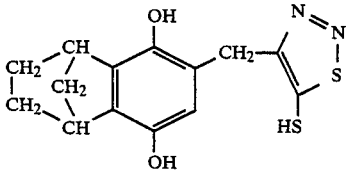
(12)
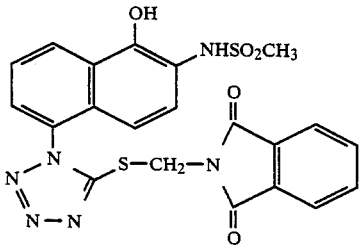
-continued
(13)
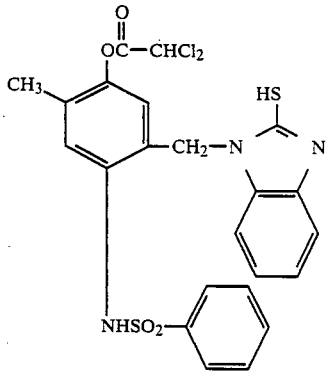
(14)
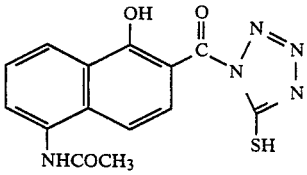
(15)
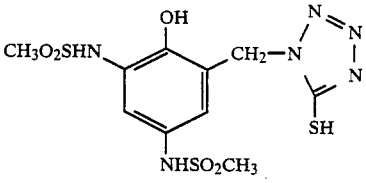
(16)
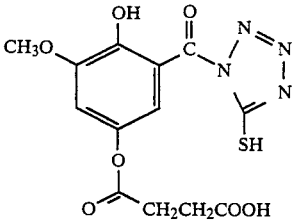
(17)
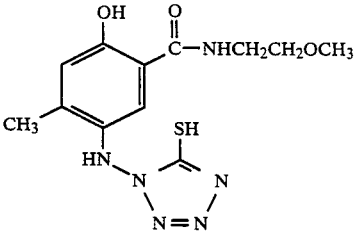
(18)
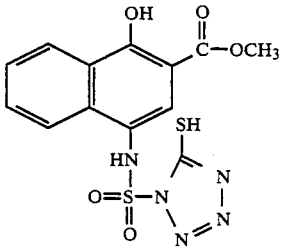

-continued
(19)
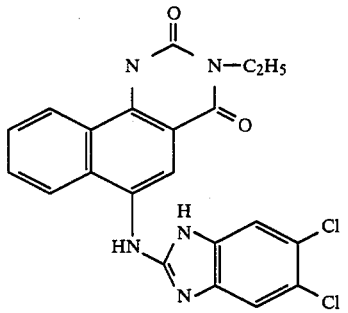
(20)
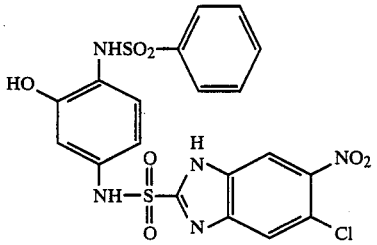
(21)
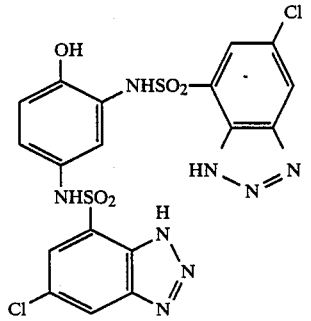
(22)
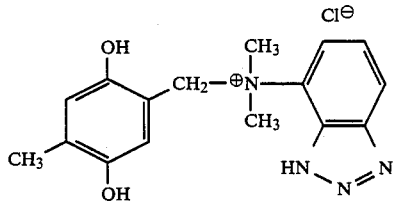
(23)
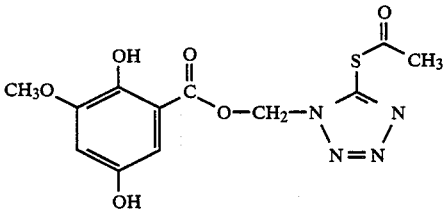
(24)
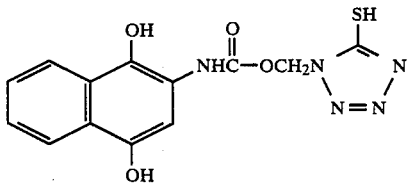
-continued
(25)
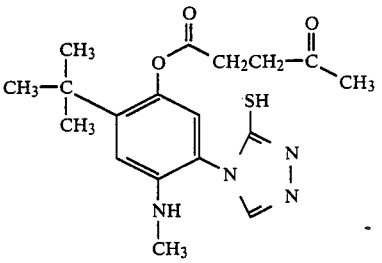
(26)
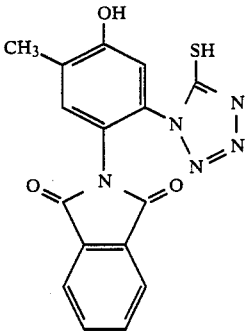
(27)
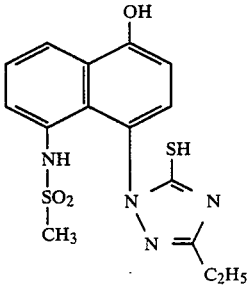
(28)
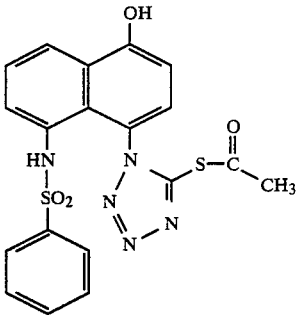
(29)
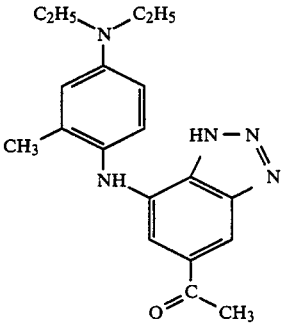

-continued
(30)
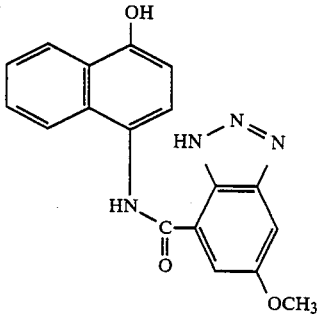
(31)
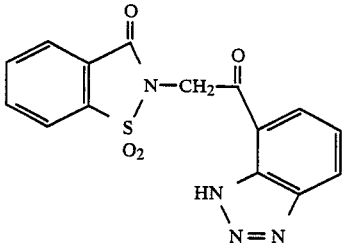
(32)
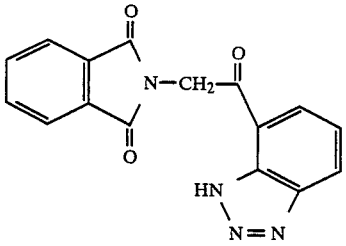
(33)
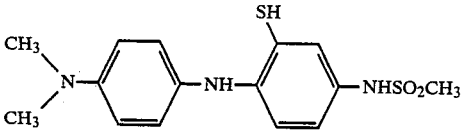
(34)
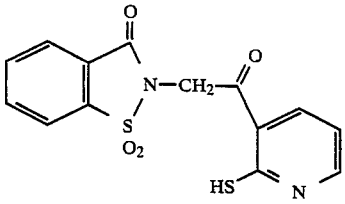
(35)
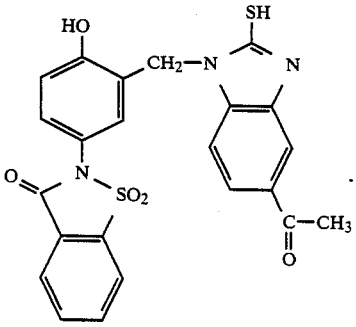
-continued
(36)
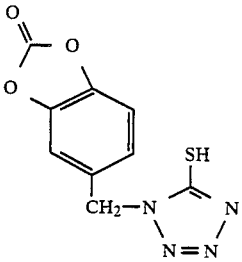
(37)
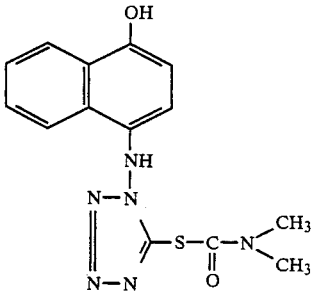
(38)
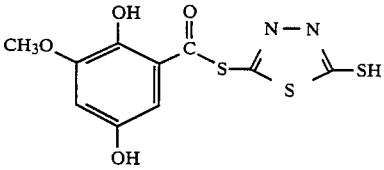
(39)
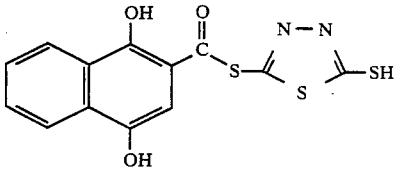
(40)
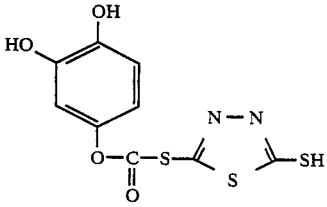
(41)
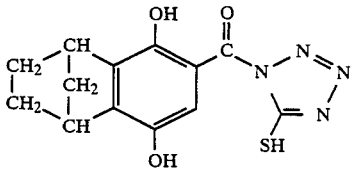
(42)
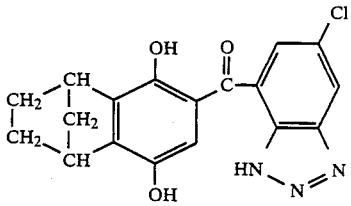

-continued
(43)
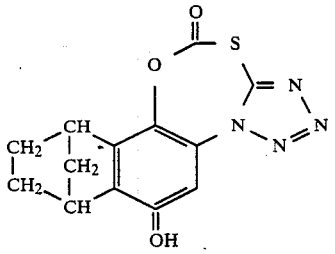
(44)
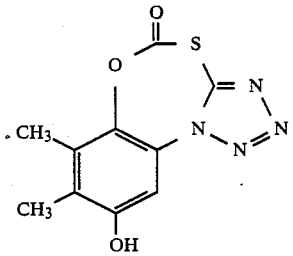
(45)
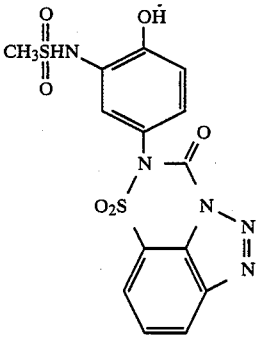
(46)
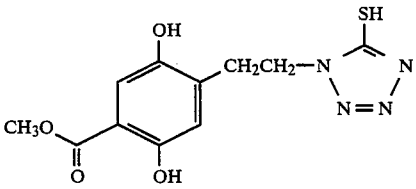
(47)
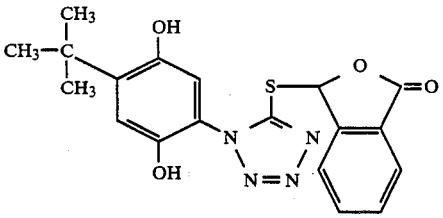
(48)
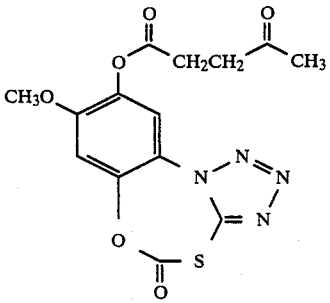
-continued
(49)
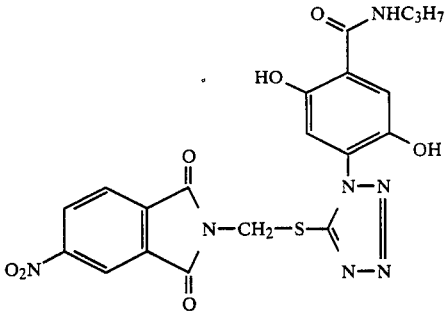
(50)
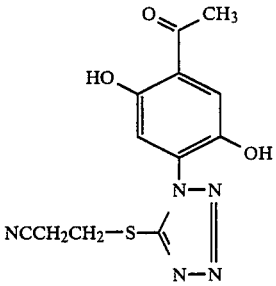
(51)
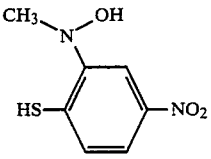
(52)
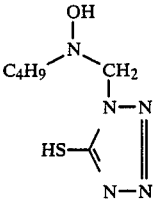
(53)
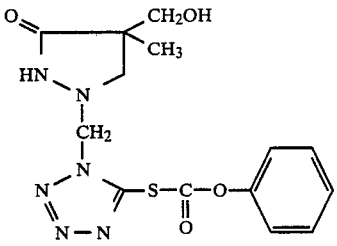
(54)
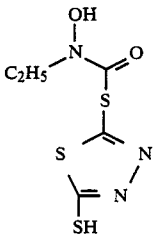

-continued (55)

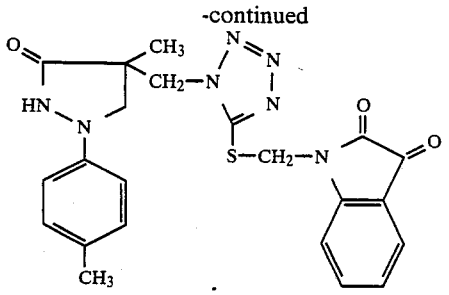

The compounds illustrated above can be easily synthesized by (1) connecting a known compound according to the KP rule and a known antifoggant by using an appropriate linking group, or (2) introducing a linking group into a reducing agent according to the KP rule followed by introducing an adsorbing moiety to the linking group.

Typical synthesis examples are specifically set forth below.

SYNTHESIS EXAMPLE 1

Synthesis of Compound (1)

To a solution of 2,5-dimethoxyaniline (61.2 g, 0.4 mol) and triethylamine (75 ml, 0.48 mol) in 300 ml of tetrahydrofuran was added carbon disulfide (91.2 g, 0.48 mol) at 5° C. and stirring was continued for 3 hours. To the reaction mixture kept at 5° C. was added N,N'-dicyclohexylcarbodiimide (99 g, 0.48 mol) and stirring was continued for another 3 hours. To the reaction mixture were added 2N HCl solution (100 ml) and hexane (100 ml) and an aqueous layer was separated. n-Hexane (100 ml) was further added to an organic layer and precipitates were filtered off. The solvents were distilled off under reduced pressure and a crude oily product was obtained. Separation and purification by chromatography using a silica gel column gave oily 2,5-dimethoxyphenylisothiocyanate (45 g, yield 57%).

2,5-Dimethoxyphenylisothiocyanate (39 g, 0.22 mol) and sodium azide (14.3 g, 0.22 mol) were added to a mixture of water (150 ml) and ethanol (60 ml) and the mixture was heated on a steam bath to about 80° C. to 90° C. with stirring for 3 hours. The reaction mixture was cooled to room temperature and a 2N HCl solution (100 ml) was added. The raw crystals formed were collected by filtration and recrystallized from isopropanol to obtain 1-(2,5-dimethoxyphenyl)-5-mercaptotetrazole (35.7 g, yield 75%). The melting point was 151° to 152° C.

1-(2,5-Dimethoxyphenyl)-5-mercaptotetrazole (23.8 g, 0.1 mol) was added to methylene chloride (200 ml) and a solution of boron tribromide (50 g, 0.2 mol) in 100 ml of methylene chloride was added dropwise. After completion of addition, stirring was continued at room temperature for 3 hours, and ice-cooled water (100 ml) was slowly added to the reaction mixture. The crystals formed were filtered off and Compound (1) was obtained (17.6 g, yield 84%). The melting point was 169° to 171° C.

SYNTHESIS EXAMPLE 2

Synthesis of Compound (3)

Isatin (25 g, 0.17 mol) and 30% formalin (30 ml, 0.3 mol) were added to a mixture of dioxane (10 ml) and water (20 ml) and the mixture was heated at 100° C. for 5 hours. The reaction mixture was cooled and crystals formed were filtered off. N-hydroxymethylisatin (28 g, yield 93%) was obtained. The melting point was 138° C. (decomposed).

N-Hydroxymethylisatin (10 g, 0.056 mol) was added to thionyl chloride (100 ml) and the mixture was heated under reflux for 2 hours. N-Chloromethylisatin (about 11 g) was obtained by distilling the remaining thionyl chloride under reduced pressure. The melting point was 121° to 123° C.

N-Chloromethylisatin (9.8 g, 0.05 mol) was dissolved in tetrahydrofuran (100 ml) and to the resulting solution were added dropwise Compound (1) (10.5 g, 0.05 mol) and a solution of sodium methoxide (2.7 g, 0.05 mol) in tetrahydrofuran (30 ml) at room temperature. After stirring for 30 minutes, an undissolved portion was filtered off and the solvent was distilled off to give a crude product. Recrystallizing the crude product from methanol gave Compound (3) (15.9 g, yield 86%). The melting point was 137° to 140° C.

SYNTHESIS EXAMPLE 3

Synthesis of Compound (39)

1,4-Dihydroxy-2-phenoxycarbonylnaphthalene (28 g, 0.1 mol), 2,5-dimercapto-1,3,4-thiadiazole (15 g, 0.1 mol) and sodium methoxide (5.4 g, 0.1 mol) were added to acetonitrile (200 ml) and the mixture was stirred at room temperature for 3 hours. To the reaction mixture was added 1N HCl (100 ml) and the mixture was extracted twice by two 100 ml portions of ethyl acetate. The extract was washed with water, dried over anhydrous sodium sulfate and the solvent was stripped off the mixture to give a crude product. Separation and purification by chromatography using a silica gel column gave Compound (39) (14.1 g, yield 42%). The melting point was 114° to 117° C.

The novel antifoggants according to the present invention may be incorporated into silver halide photographic materials or may be added to a developing solution as a developing component. When the antifoggant is incorporated into a silver halide photographic material, the compound having a mercapto group on a heterocyclic nucleus as an adsorbing group is incorporated in an amount of about $10^{-9}$ to $10^{-1}$ mol, preferably about $10^{-6}$ to $10^{-2}$ mol, per mol of silver, and the compound having a cyclic —NH-group is incorporated in an amount of about $10^{-8}$ to $10^{-1}$ mol, preferably about $10^{-5}$ to $10^{-2}$ mol, per mol of silver. The antifoggant is added to a processing solution in an amount of about $10^{-4}$ to 1 mol, preferably about $10^{-3}$ to $10^{-1}$ mol, per liter. When the antifoggant is incorporated into a silver halide photographic material, it may be added effectively to any of the layers of the photographic material, e.g., a silver halide emulsion layer, a color providing layer, a subbing layer, a protective layer, an intermediate layer, a filter layer, an antihalation layer, an image receiving layer, layers of a cover sheet and other auxiliary layers.

In adding the antifoggant to be employed in the present invention to the above described layers, the antifoggants are added to the coating composition for forming the desired layers respectively as they are, or in a form of solutions prepared by dissolving in a solvent which does not adversely affect the photographic material, e.g., water, alcohol, etc., in appropriate concentrations. Also, the antifoggant can be first dissolved in high boiling point organic solvents and/or low boiling point organic solvents and, further, dispersed in water in the form of an emulsion and then added to the coating compositions. In addition, polymer latexes impregnated with the antifoggant according to the methods described in Japanese Patent Application (OPI) Nos. 39853/76, 59942/76 and 32552/79, U.S. Pat. No. 4,199,363, etc., may be employed.

The antifoggants having a mercapto group on a heterocyclic ring as an adsorbing moiety are preferably incorporated into photographic materials as precursors having a blocked mercapto group with respect to reduced desensitization at the exposure stage.

The antifoggants according to the present invention can be employed in a color photographic material based on color forming couplers.

A common method for forming a color image from a color photographic material employs developing a silver halide photographic material by using a developer of an aromatic primary amine in the presence of color couplers which have a function to form dyes by reacting the oxidized developers, to produce azomethine dyes or indoaniline dyes. The basis of the above described color development method was invented by L. D. Mannes & L. Godowsky in 1935 and thereafter various improvements have been introduced thereinto. Nowadays, this color development method is universally employed in the art.

In this method, the subtractive color process is usually employed for color reproduction, wherein silver halide emulsions which are sensitive selectively to blue, green and red lights, respectively, and yellow, magenta and cyan color image forming agents which bear their respective complementary relations to those lights are used. In order to form yellow color images, couplers of, e.g., an acylacetanilide type, a dibenzoylmethane type or an azo dye releasing type are used. In order to form magenta color images, couplers of a pyrazolone type, a pyrazolobenzimidazole type, a cyanoacetophenone type, an indazolone type or a pyrazolotriazole type are predominantly used. In order to form cyan images, couplers of a phenol type (e.g., 2-phenylureido-5-acylaminophenols) and a naphthol type are predominantly used.

In general, color photographic materials are divided into two main groups; one group consists of a coupler-in-developer type, which utilizes couplers added to a developing solution, and the other group consists of a coupler-in-emulsion type, which contains couplers in the photographic layers in such a state that the couplers may retain their own functions independently. In the latter material, dye image forming couplers are incorporated into silver halide emulsion layers. For couplers to be added to emulsion layers, it is necessary that they be rendered nondiffusible (diffusion resistant) in the matrix of emulsion binder.

The processing steps of color photographic materials of the coupler-in-emulsion type comprise basically the following three steps:

(1) Color development step
(2) Bleaching step
(3) Fixing step

The processing steps of color reversal photographic materials comprise the following steps:

(1) Negative black-and-white development step
(2) Fogging followed by color development
(3) Bleaching step
(4) Fixing step The bleaching step and the fixing step may be carried out at the same time. Such a combination is called a bleach-fixing, or blixing step, and both developed silver and undeveloped silver halide are desilvered in this step. Besides involving the above described two basic steps, i.e., the color development step and the desilvering step, the actual processing for development processing includes auxiliary steps for purposes of retaining photographic and physical qualities of the image, improving the storability of the image, etc. For instance, there are steps using a hardening bath for preventing photographic films from being excessively softened during the processing, a stop bath for stopping a development reaction effectively, an image stabilizing bath for stabilizing images, a layer removing bath for removing a backing layer from the support, etc.

The antifoggants according to the present invention show marked antifogging effects particularly under conditions easily causing fog such as high pH processing, processing at elevated temperature, or prolonged development like push development.

Couplers are added to or dispersed into gelatino-silver halide emulsions or hydrophilic colloids according to conventionally known methods. Specifically, a method of dispersing a coupler in the form of a mixture with an organic solvent having a high boiling point such as dibutyl phthalate, tricresyl phosphate, waxes, a higher fatty acid or its ester, etc., a method as described in, e.g., U.S. Pat. Nos. 2,304,939 and 2,322,027, etc.; a method of dispersing a coupler in the form of a blend with an organic solvent having a low boiling point or a water-soluble organic solvent; a method of dispersing a coupler in the form of a mixture with a combination of an organic solvent having a low boiling point; a method as described in, e.g., U.S. Pat. Nos. 2,801,170, 2,801,171 and 2,949,360, etc.; and a method of dispersing a coupler by itself or in combination with other couplers required for combined use, such as a colored coupler and an uncolored coupler can be employed. In the case that the coupler per se has a low melting point (e.g., not higher than 75° C.), such a method as described in German Pat. No. 1,143,707, etc., can be employed.

Conventionally used surfactants can be employed as dispersion aids. Typical examples include anion surfactants (e.g., sodium alkylbenzenesulfonate, sodium dioctylsulfosuccinate, sodium dodecylsulfate, sodium alkylnaphthalenesulfonate, couplers of the Fischer type), zwitterionic surfactants (e.g., N-tetradecyl-N,N-dipolyethylene-$\alpha$-betaine) and nonionic surfactants (e.g., sorbitan monolaurate).

In combination with the antifoggants of the present invention, any of known couplers can be employed. Typical examples include a compound ofn the naphthol and phenol type, a compound of the pyrazolone and pyrazoloazole type and a compound of the open chain or heterocyclic ketomethylene type. Examples of cyan, magenta and yellow color forming couplers which can be employed in the present invention are described in the patents cited in *Research Disclosure,* No. 17643 (December, 1978), Section VII-D and ibid., No. 18717 (November, 1979).

Color forming couplers for incorporation into photographic materials are preferably nondiffusible by being ballasted or polymerized. 2-equivalent couplers having a coupling-off group at the coupling active position are more preferable than 4-equivalent couplers having only hydrogen at the coupling position. Couplers which can be employed in the present invention include couplers which form a dye of controlled image or colorless couplers as well as DIR couplers which release a development inhibiting reagent upon the coupling reaction and couplers releasing a development accelerating agent.

Representative examples of yellow couplers useful in the present invention include couplers of the "oil-protected" (hydrophobically ballasted) acylacetamide type, as illustrated in U.S. Pat. Nos. 2,407,210, 2,875,057 and 3,265,506. Typical examples of 2-equivalent yellow couplers preferable in the present invention include yellow couplers having an oxygen-linked coupling-off group as illustrated in U.S. Pat. Nos. 3,408,194, 3,447,928, 3,933,501 and 4,022,620; yellow couplers having a nitrogen-linked coupling-off group as illustrated in Japanese Patent Publication No. 10739/83, U.S. Pat. Nos. 4,401,752 and 4,326,024, *Research Disclosure,* No. 18053 (April, 1979), British Pat. No. 1,425,020 and German Patent Application (OLS) Nos. 2,219,917, 2,261,361 and 2,433,812. Couplers of the α-pivaloylacetanilide type are superior in fastness of formed dyes particularly on exposure to light, while couplers of the α-benzoylacetanilide type are capable of forming high maximum density.

Magenta couplers useful for the present invention include "oil-protected" couplers of the indazolone or cyanoacetyl type, preferably of the 5-pyrazolone or pyrazoloazole (e.g., pyrazolotriazole) type. 5-Pyrazolones substituted with an arylamino or acylamino group at 3-position are preferable with respect to the hue and maximum densities of formed dyes and are illustrated in U.S. Pat. Nos. 2,311,082, 2,343,703, 2,600,788, 2,908,573, 3,062,653, 3,152,896 and 3,936,015. 2-Equivalent 5-pyrazolone couplers are preferable since they are capable of providing high image density with less silver coverage, and particularly preferable coupling-off groups are nitrogen-linked coupling-off groups described in U.S. Pat. No. 4,310,619 and an arylthio group described in U.S. Pat. No. 4,351,897. The ballast group described in European Pat. No. 73,636 have effects to enhance developed density and are useful to couplers of the 5-pyrazolone type. Examples of pyrazoloazole couplers include pyrazolobenzimidazole described in U.S. Pat. No. 3,369,897, more preferably pyrazolo[5,1-c][1,2,4]-triazoles described in U.S. Pat. No. 3,725,067, pyrazolotetrazoles described in *Research Disclosure,* No. 24220 (June, 1984) and pyrazolopyrazole described in *Research Disclosure,* No. 24230 (June, 1984). Imidazo[1,2,b]pyrazoles described in European Pat. No. 119,741 are preferable and pyrazolo[1,5-b][1,2,4]triazoles described in European Pat. No. 119,860 are particularly preferable with respect to the reduced yellow side absorption and fastness of developed dyes on exposure to light.

Suitable couplers include "oil-protected" couplers of the naphthol and phenol type. Typical examples are naphthol couplers as illustrated in U.S. Pat. No. 2,474,293, preferably 2-equivalent naphthol couplers having an oxygen-linked coupling-off group as illustrated in U.S. Pat. Nos. 2,052,212, 4,146,396, 4,228,233 and 4,296,200. Examples of phenol couplers are described in U.S. Pat. Nos. 2,369,929, 2,801,171, 2,772,162, 2,895,826, etc.

Cyan couplers capable of providing image dyes durable on exposure to humidity and/or heat are used preferably in the present invention, and typical examples include phenol cyan couplers described in U.S. Pat. No. 3,772,002; couplers of the 2,5-diacylamino-substituted phenol type as illustrated in U.S. Pat. Nos. 2,772,162, 3,758,308, 4,126,396, 4,334,011 and 4,327,173, German Patent Application (OLS) No. 3,329,729 and Japanese Patent Application No. 42671/83; and phenol couplers substituted with a phenylureido group at the 2-position and with an acylamino group at the 5-position as illustrated in U.S. Pat. Nos. 3,445,662, 4,333,999, 4,451,559 and 4,427,767.

Color forming couplers are incorporated in an amount of about 0.002 to 0.5 mol per mol of light-sensitive silver halide present in the layer. In color photographic materials for photographing, yellow couplers are used in an amount of about 0.01 to 0.5 mol, magenta couplers are used in an amount of about 0.003 to 0.25 mol and cyan couplers are preferably used in an amount of about 0.002 to 0.12 mol, per mol of light-sensitive silver halide; in color photographic materials for prints (e.g., color papers), yellow, magenta and cyan couplers each is employed often in an amount of 0.1 to 0.5 mol per mol of light-sensitive silver halide. It is possible to design photographic materials outside the above described ranges.

Two or more antifoggants of the present invention or two or more couplers may be employed in a layer in order to satisfy the properties necessary for the photographic materials and the same compound may be employed in two or more layers.

In color photographic materials for photographing, colored couplers may be employed in combination with magenta and cyan couplers in order to compensate for the unnecessary absorption located at shorter wavelength regions of the developed dyes. Typical examples include yellow colored magenta coupler as illustrated in U.S. Pat. No. 4,163,670 and Japanese Patent Publication No. 39413/82 and magenta colored cyan couplers as illustrated in U.S. Pat. Nos. 4,004,929 and 4,138,258 and British Pat. No. 1,146,368.

The above mentioned couplers may form a polymer including a dimer. Typical examples of polymer couplers are illustrated in U.S. Pat. Nos. 3,451,820 and 4,080,211. Polymer magenta couplers are described in British Pat. No. 2,102,173 and U.S. Pat. No. 4,367,282.

Couplers capable of providing diffusible image dyes may be employed to improve granularity. Magenta couplers of this type are described in U.S. Pat. No. 4,366,237 and British Pat. No. 2,125,570 and specific examples of yellow, magenta and cyan couplers of this type are described in European Pat. No. 96,873 and German Patent Application (OLS) No. 3,324,533.

The photographic material of the present invention may contain couplers capable of releasing a development inhibitor upon development ("DIR couplers").

Examples of DIR couplers include compounds releasing, as a development restrainer, a heterocyclic mercapto compound described in U.S. Pat. No. 3,227,554, etc.; compounds releasing a benzotriazole derivative as a development restrainer described in Japanese Patent Publication No. 9942/83; non-color-forming DIR couplers described in Japanese Patent Publication No. 16141/76; compounds releasing a nitrogen-containing heterocyclic development restrainer as a result of the decomposition of a methylol group after the coupling-off reaction described in Japanese Patent Application (OPI) No. 90932/77; compounds releasing a development restrainer upon an intramolecular nucleophilic reaction after the coupling-off reaction described in U.S. Pat. No. 4,248,962; compounds releasing a development restrainer upon electron transfer via a conjugated system after the coupling-off reaction described in Japanese Patent Application (OPI) Nos. 114946/81, 56837/82, 154234/82, 188035/82, 98728/83, 209736/83, 20937/83, 209738/83 and 209740/83; compounds releasing a diffusible development restrainer which is eventually deactivated in a developing solution, described in Japanese Patent Application (OPI) Nos. 151944/82 and 217932/83, Japanese Patent Application Nos. 75474/84, 82214/84 and 90438/84; and compounds releasing a reactive compound which generates or deactivates a development restrainer during development.

Among the above mentioned DIR couplers, preferable examples which can be used in combination with the present invention are compounds releasing a restrainer deactivated in a developing solution (so-called "super-DIR") exemplified by Japanese Patent Application (OPI) No. 151944/82; a so-called "timing DIR" coupler exemplified by U.S. Pat. No. 4,248,162 and Japanese Patent Application (OPI) No. 154234/82; a reactive compound releasing DIR couplers exemplified by Japanese Patent Application No. 39653/84. Particularly preferable compounds are "super-DIR" compounds as illustrated in Japanese Patent Application (OPI) No. 151944/82 and reactive DIR couplers as illustrated in Japanese Patent Application No. 36953/84.

In addition to DIR couplers, photographic materials of the present invention may contain compounds releasing a development restrainer during development, and such examples are illustrated in U.S. Pat. Nos. 3,297,455 and 3,379,529 and German Patent Application (OLS) No. 2,417,914 and Japanese Patent Application (OPI) Nos. 15271/77 and 9116/83.

Photographic materials of the present invention may contain compounds releasing a reducing agent such as hydroquinones, aminophenols, bis(sulfonamido)phenols or pyrazolidones, as illustrated in U.S. Pat. No. 3,408,194, Japanese Patent Application (OPI) No. 138636/82 and Japanese Patent Application No. 33059/84.

Photographic materials of the present invention may contain compounds releasing, upon development, a nucleating agent such as hydrazine derivatives, thioamides, thioureas, aldehydes, acetylene derivatives, tertiary onium salts or tetrazolium salts, as illustrated in Japanese Patent Application (OPI) Nos. 150845/82 and 50439/84, Japanese Patent Application Nos. 31611/83, 31610/83, 156097/83, 214808/83 and 237101/83 may be employed. The use of these compounds enables an increase in the sensitivity of and a decrease in the fog of the photographic materials.

In the present invention compounds can be used which accelerate the deblocking reaction of the antifoggant precursors, such as hydroxylamines, hydroxamic acids, oximes, N-oxides, etc.

The antifoggants of the present invention and aforementioned couplers used in combination therewith can be added to photographic materials by various known dispersing techniques. Typically, the antifoggants, etc., may be added according to the solid dispersing process, the alkaline dispersing process, preferably, to the latex dispersing process, more preferably, to the oil-in-water dispersing process. According to the oil-in-water dispersing process, dispersants are first dissolved in a single or mixed solvent of a high boiling (boiling above 175° C.) organic solvent or a low boiling (auxiliary) organic solvent, and then dispersed as fine particles in an aqueous medium, e.g., water or an aqueous gelatin solution in the presence of surface active agents.

Examples of the high boiling organic solvents are described in U.S. Pat. No. 2,322,027, etc. The dispersing process may be carried out by employing the inversion of the aqueous and organic phases, and the low boiling organic solvent may be removed or decreased, if necessary, by distillation, noddle washing, ultrafiltration, etc., before preparation of a coating solution.

Examples of high boiling organic solvents include esters of phthalic acid (e.g., dibutyl phthalate, dicyclohexyl phthalate, di-2-ethylhexyl phthalate, didodecyl phthalate), esters of phosphoric or phosphonic acids (e.g., triphenyl phosphate, tricresyl phosphate, 2-ethylhexyldiphenyl phosphate, tri-2-ethylhexyl phosphate, tridecyl phosphate, tributoxyethyl phosphate, trichloropropyl phosphate, di-2-ethylhexylphenyl phosphonate), benzoic acid esters (e.g., 2-ethylhexyl benzoate, dodecyl benzoate, 2-ethylhexyl p-hydroxybenzoate), alkyl amides (e.g., diethyl dodecanamide, N-tetradecylpyrrolidone), alcohols and phenols (e.g., isostearylalcohol, 2,4-di-tert-amylphenol), esters, of fatty acids (dioctyl azelate, glycerol tributylate, isostearyl lactate, trioctyl citrate), anilines (e.g., N,N-dibutyl-2-butoxy-5-tert-octylaniline), hydrocarbons (e.g., paraffin, dodecylbenzene, diisopropylnaphthalene), etc.; and organic solvents having a boiling point of about 30° C. to about 160° C. can be used as an auxiliary solvent. Typical examples thereof include ethyl acetate, ethyl propionate, methyl ethyl ketone, cyclohexanone, 2-ethoxyethyl acetate, dimethylformamide, etc.

The process of the latex dispersion, advantages thereof and specific examples of latexes useful for the process are described in U.S. Pat. No. 4,199,363, German Patent Application (OLS) Nos. 2,541,274 and 2,541,230.

When the present invention is applied to the color diffusion transfer process, the silver halide photographic material of the present invention can have a film unit structure of the peel-apart type; integrated type as described in Japanese Patent Publication Nos. 16356/71 and 33697/73, Japanese Patent Application (OPI) No. 13040/75 and British Pat. No. 1,330,524; or non-peel-apart type as described in Japanese Patent Application (OPI) No. 119345/82.

In every format described above, it is advantageous from the standpoint of broadening the latitude of the processing temperature to provide a polymeric acid layer protected by a neutralization timing layer. When applied to color diffusion transfer photography, the compound of the present invention can be incorporated in any layer of the photographic material or be contained in a processing container as a component of the processing liquid The present invention can also be employed in black-and-white photographic materials. Specific examples of black-and-white photographic materials include direct medical X-ray films, black-and-white films for general photographing, litho films, scanner films and general photographing, litho films, scanner films and general black-and-white papers, etc. The present invention is particularly effective to restrain fog caused by over-development at elevated temperature or under prolonged periods.

In the silver halide emulsion layer of the color photographic material according to the present invention, any of silver bromide, silver iodobromide, silver chlorobromoiodide, silver chlorobromide or silver chloride can be used. Silver bromoiodide containing silver iodide less than about 15 mol% is preferable. Silver bromoiodide containing about 2 to 12 mol% of silver iodide is most preferable.

Silver halide grains in the photographic emulsion may have a regular crystal structure such as a cubic, hexahedral or tetradecahedral structure, an irregular crystal structure such as a spherical structure or a composite crystal structure thereof. Further, a photographic emulsion may be employed wherein at least 50% of the total projected area of silver halide grains is tabular grains having a thickness of about 0.5 μm or less, a diameter of at least about 0.6 μm and an average aspect ratio of about 5 or more as described in *Research Disclosure,* No. 22534.

Silver halide grains may have a uniform structure or a structure in which the internal and external portions differ in composition from each other, may have a layered structure or a structure in which silver halides of different compositions are joined to each other by epitaxial junction, or may comprise a mixture of grains of various crystal forms.

Silver halide grains forming a latent image primarily on the grain surface or silver grains forming a latent image in the interior of the grains may be used.

The silver halide grains may have a grain size as small as about 0.1 μm or less or as large as 10 μm in projected area diameter, and either monodisperse emulsions having a narrow distribution of grain size or polydisperse emulsions having a wide distribution may be used.

The present invention is not particularly limited in terms of the other constitutions of the silver halide photographic material, e.g., the method of making silver halide emulsions, the halide composition, the crystal habit, the grain size, the chemical sensitizers, the stabilizers, the surface active agents, the gelatin hardeners, the hydrophilic colloidal binder, the matting agents, the dyes, the spectral sensitizing dyes, the discoloration inhibitors, the color mixing inhibitors, the polymer latexes, the brightening agents, the antistatic agents, etc. As for these aspects, descriptions in *Research Disclosure,* Vol. 176, pp. 22–23 (December, 1978) can be employed in the present invention.

The developing solution employed for black-and-white photographic processing can contain known developing agents. Suitable developing agents include dihydroxybenzenes (e.g., hydroquinone), 3-pyrazolidones (e.g., 1-phenyl-3-pyrazolidone), aminophenols (e.g., N-methyl-p-aminophenol), etc. These can be used alone or in combination. The developing solution can generally contain, in addition to the above described developing agents, known preservatives, alkali agents, pH buffering agents and antifoggants and, optionally, may contain dissolving aids, color toning agents, water softeners, hardeners, viscosity imparting agents, etc.

The photographic emulsions of the present invention can also be subjected to the so-called "lithographic" development processing, if desired.

Color developing solution generally contains a color developing agent. Suitable examples of color developing agents which can be used include known aromatic primary amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition to the above described color developing agents, those described in L. F. A. Mason, *Photographic Processing Chemistry,* pp. 226–229, Focal Press, London (1966), U.S. Pat. Nos. 2,193,015 and 2,592,364, Japanese Patent Application (OPI) No. 64933/73, etc., may also be employed.

After color development, the photographic emulsion layers are usually bleached. Bleaching may be effected either simultaneously with fixing, or independently. As bleaching agents, compounds of polyvalent metals such as iron (III), cobalt (III), chromium (VI), copper (II), peracids, quinones and nitroso compounds are used. For example, ferricyanates, dichromates, organic complex salts of iron (III) or cobalt (III) such as complexes of aminopolycarboxylic acids (e.g., ethylene diaminetetraacetic acids, nitrilotriacetic acid or 1,3-diamino-2-propanoltetraacetic acid) or organic acids (e.g., citric acid, tartaric acid or malic acid), persulfates, permanganates or nitrosophenols may be used. Of these, potassium ferricyanate, iron (III) sodium ethylenediaminetetraacetate, and iron (III) ammonium ethylenediaminetetraacetate are particularly useful. Iron (III) ethylenediaminetetraacetates are useful in both independent bleaching solution and a monobath bleach-fixing solution.

The color development or the bleach-fixing may be followed by washing with water. Color development may be effected at any temperature between about 18° C. and 55° C., preferably at about 30° C. or above, particularly preferably at about 35° C. or above. Developing time is typically about 3.5 minutes to 1 minute, and the shorter the better. In continuous development processing, it is preferable to replenish the developer, and the replenishing solution is added in an amount of about 350 cc or less, preferably about 100 cc or less per $m^2$ of processed area of photographic materials. The concentration of benzyl alcohol in the developing solution is about 20 ml/liter or less, preferably about 10 ml/liter or less. Bleach-fixing may be conducted at any temperature between about 18° C. and 50° C., preferably at about 30° C. or above. When bleach-fixing is conducted at about 35° C. or above, the processing time can be shortened to about 1 minute or less, and the amount of replenishing solution can be reduced. Washing with water after color development or bleach-fixing is usually conducted for 3 minutes or less, and may be conducted within 1 minute using a stabilizing bath.

Developed dyes are deteriorated and faded by fungi during storage as well as by light, heat or humidity. Cyan color images in particular are deteriorated by fungi, and hence the use of antifungal agents is preferable. Specific examples of the antifungal agents include 2-thiazolylbenzimidazoles as described in Japanese Patent Application (OPI) No. 157244/82. The antifungal agents may be incorporated in photographic materials, added to a solution in development processing, or applied to the processed photographic materials at any step.

The present invention will now be described by reference to specific examples which are not meant to be limiting.

Unless otherwise indicated, all percents, ratios, etc., are by weight.

EXAMPLE 1

On a cellulose triacetate film support having thereon a subbing layer were coated the layers described below in the order listed. To the emulsion layer was added an emulsified dispersion prepared by dissolving one of the antifoggants set forth in Table 1 and Magenta Coupler (C-1) in a mixture of tricresyl phosphate and ethyl acetate and then dispersing the resulting solution into a gelatin aqueous solution to prepare Samples 1 to 10. The coverage of each component is shown in parentheses in terms of $g/m^2$ or $mol/m^2$.

(1) Emulsion layer containg a silver iodobromide negative emulsion (grain size: 1.5 μm, silver: $1.6\times10^{-2}$ $mol/m^2$), the antifoggant ($4.0\times10^{-6}$ $mol/m^2$), Magenta Coupler (C-1) ($1.33\times10^{-3}$ $mol/m^2$), tricresyl phosphate (0.95 $g/m^2$) and gelatin (2.5 $g/m^2$).

(2) Protective layer containing the sodium salt of 2,4-dichloro-6-hydroxy-s-triazine (0.05 $g/m^2$) and gelatin (1.30 $g/m^2$).

These films were allowed to stand for 14 hours at a temperature of 40° C. and a relative humidity of 70% and thereafter subjected to sensitometric exposure using white light and, subsequently, to the color development processing described below. The densities of the processed samples were measured using green light to obtain data concerning photographic properties.

| Color Development Processing | Time | Temperature |
|---|---|---|
| 1. Color Development | 3 min 15 sec | 38° C. |
| 2. Bleaching | 6 min 30 sec | " |
| 3. Washing | 2 min | " |
| 4. Fixing | 4 min | " |
| 5. Washing | 4 min | " |
| 6. Stabilizing | 1 min | " |

The processing solutions used in the above described steps respectively had the following compositions.

| | |
|---|---|
| **Color Developing Solution** | |
| Water | 800 ml |
| 4-(N—Ethyl-N—hydroxyethyl)amino-2-methylaniline Sulfate | 5 g |
| Sodium Sulfite | 5 g |
| Potassium Carbonate | 30 g |
| Potassium Hydrogencarbonate | 1.2 g |
| Potassium Bromide | 1.2 g |
| Sodium Chloride | 0.2 g |
| Trisodium Nitrilotriacetate | 1.2 g |
| Water to make | 1 liter (pH 10.1) |
| **Bleaching Solution** | |
| Water | 800 ml |
| Ammonium Ethylenediaminetetraacetonato-ferrate (III) | 100 g |
| Disodium Ethylenediaminetetraacetate | 10 g |
| Potassium Bromide | 150 g |
| Acetic Acid | 10 g |
| Water to make | 1 liter (pH 6.0) |
| **Fixing Solution** | |
| Water | 800 ml |
| Ammonium Thiosulfate | 150 g |
| Sodium Sulfite | 10 g |
| Sodium Hydrogensulfite | 2.5 g |
| Water to make | 1 liter (pH 6.0) |
| **Stabilizing Solution** | |
| Water | 800 ml |
| Formaldehyde (37% aq. soln.) | 5 ml |
| Fuji Driwel | 3 ml |
| Water to make | 1 liter |

The sensitometric results obtained for Samples 1 to 10 are shown in Table 1 below.

TABLE 1

| Sample No. | Antifoggant | Fog | Relative Sensitivity* |
|---|---|---|---|
| 1 | None | 0.15 | 100 |
| 2 | Compound (1) | 0.07 | 92 |
| 3 | Compound (3) | 0.09 | 98 |
| 4 | Compound (7) | 0.13 | 100 |
| 5 | Compound (21) | 0.11 | 98 |
| 6 | Compound (23) | 0.10 | 98 |
| 7 | Compound (39) | 0.06 | 91 |
| 8 | Compound (43) | 0.09 | 95 |
| 9 | Reference Compound 1-A | 0.02 | 28 |
| 10 | Reference Compound 1-B | 0.06 | 46 |

*Relative sensitivity was represented by the reciprocal of exposure amount corresponding to the color density of (fog + 0.2) and expressed as relative values to 100 of Control Sample No. 1.

As can be seen from the results in Table 1, Samples Nos. 2 to 8 using the antifoggant of the present invention show reduced fog without essentially decreasing the sensitivity.

The antifoggants for comparison and couplers used are shown below.

Reference Compound 1-A

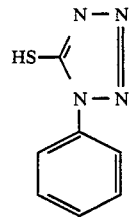

Reference Compound 1-B

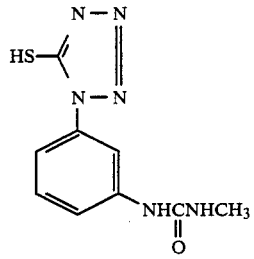

Magenta Coupler (C-1)

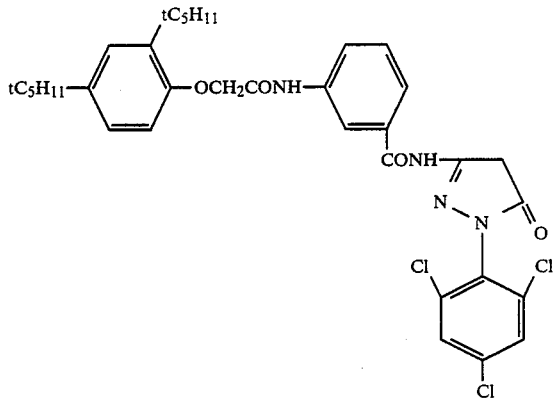

EXAMPLE 2

Color developing solutions were prepared by adding $2\times10^{-3}$ mol/l of an antifoggant of the present invention to the color developing solution of Example 1, as shown in Table 2, and Sample No. 1 of Example 1 was subjected to development processing after sensitometric exposure. The sensitometric data obtained are shown in Table 2.

TABLE 2

| Color Developing Solution | Antifoggant | Fog | Relative Sensitivity |
|---|---|---|---|
| A (Example 1) | None | 0.15 | 100 |
| B | Compound (1) | 0.09 | 95 |
| C | Compound (4) | 0.06 | 91 |
| D | Compound (15) | 0.05 | 89 |
| E | Compound (39) | 0.11 | 98 |
| F | Compound (42) | 0.13 | 100 |
| G | Reference Compound 1-A | 0.03 | 35 |
| H | Reference Compound 2-A | 0.08 | 52 |

As can be seen from the results in Table 2, Color Developing Solutions B to F containing an antifoggant of the present invention gave reduced fog without essentially decreasing the sensitivity, whereas Color Developing Solutions G and H yielded a marked decrease of sensitivity. It has been clearly demonstrated that the antifoggant according to the present invention provides, when added in a color developing solution, effects similar to those when incorporated in a photographic material to yield an image having high discrimination.

EXAMPLE 3

A gelatino silver iodobromide containing 3.5 mol% of silver iodide (the average size of silver halide grains was about 1.0 μm) was ripened by heating at 60° C. for 60 minutes in the presence of 0.6 mg of chloroaurate and 3.4 mg of sodium thiosulate per mol of silver halide. To the emulsion obtained was added 110 mg of anhydro-1-ethyl-3-(3-sulfopropyl)-3'-ethyl-5,6-dichlorobenzimidaoxacarbocyanine per mol of silver halide as green-sensitive dye, 4-hydroxy-6-methyl-1,3,3a,7-tetraazaindene as stabilizer and 0.1 g per mol of silver halide of an antifoggant as shown in Table 3 to prepare Sample Nos. 11 to 15. After being stored at 50° C. under relative humidity of 75% for 5 days, these samples were subjected to green light exposure by using a sensitometer. Exposed samples were tray-developed in High-Lendol developer (Fuji Photo Film Co., Ltd.) at 20° C. for 4 minutes. The sensitometric results of these samples obtained were shown in Table 3.

TABLE 3

| Sample No. | Antifoggant | Storage Condition: 20° C., 60% RH, 5 Days — Relative Sensitivity | Fog | 50° C., 75% RH, 5 Days — Relative Sensitivity | Fog |
|---|---|---|---|---|---|
| 11 | None | 100 | 0.03 | 69 | 0.26 |
| 12 | Compound (2) | 100 | 0.02 | 95 | 0.05 |
| 13 | Compound (38) | 100 | 0.02 | 100 | 0.07 |
| 14 | Compound (47) | 100 | 0.02 | 98 | 0.05 |
| 15 | Reference Compound 3-A | 95 | 0.02 | 85 | 0.18 |

Relative sensitivity was represented as relative value to 100 of Control Sample N. 11 which was the sensitivity under the storage conditions of 20° C., relative humidity of 60% and 5 days.

As can be seen from the results in Table 3, Sample Nos. 12 to 14 containing an antifoggant of the present invention showed remarkable effects under storage conditions of high temperature and/or high humidity to provide a silver image having reduced sensitivity loss and reduced fog.

The reference compound used is shown below:

Reference Compound 3-A

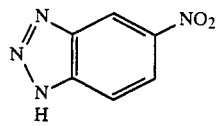

EXAMPLE 4

A cover sheet was prepared by coating in sequence the following layers (1) to (3) on a transparent polyethylene terephthalate support having a subbing layer.

(1) A layer comprising a copolymer of acrylic acid and butyl acrylate (80:20 by weight) (11 g/m²) and 1,4-bis(2,3-epoxypropoxy)butane (0.22 g/m²).

(2) A layer comprising acetyl cellulose (yielding 36.6 g of an acetyl group when 100 g of the acetyl cellulose is subjected to hydrolysis) (4.3 g/m²), a methanolysis product of a copolymer of styrene and maleic anhydride (60:40 by weight, molecular weight of about 50,000) (0.23 g/m²) and an antifoggant described in Table 4 (2 mmol/m²).

(3) A layer of 2 μm in thickness comprising a mixture consisting of a copolymer latex of styrene, n-butyl acrylate, acrylic acid and N-methylolacrylamide (49.7:42.3:3:5 by weight) and a copolymer latex of methyl methacrylate, acrylic acid and N-methylolacrylamide (93:4:3 by weight) (latex ratio of 6:4 by dry residual weight).

A light-sensitive sheet was prepared by coating the following layers on a transparent polyethylene terephthalate support:

(1) A mordant layer comprising gelatin (3.0 g/m²) and a latex formulated polymer mordant shown below (3.0 g/m²)

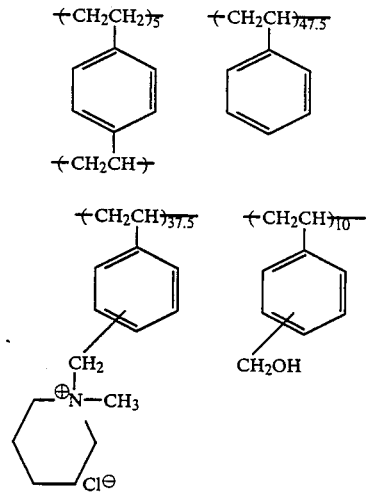

(2) A white reflective layer comprising titanium oxide (18 g/m²) and gelatin (2.0 g/m²).

(3) A light shielding layer comprising carbon black (2.0 g/m²) and gelatin (1.0 g/m²).

(4) A layer comprising the following cyan dye releasing redox compound (0.44 g/m²), tricyclohexyl phosphate (0.09 g/m$^2$), 2,5-di-t-pentadecylhydroquinone (0.008 g/m$^2$) and gelatin (0.8 g/m$^2$).

Cyan Dye Releasing Redox Compound

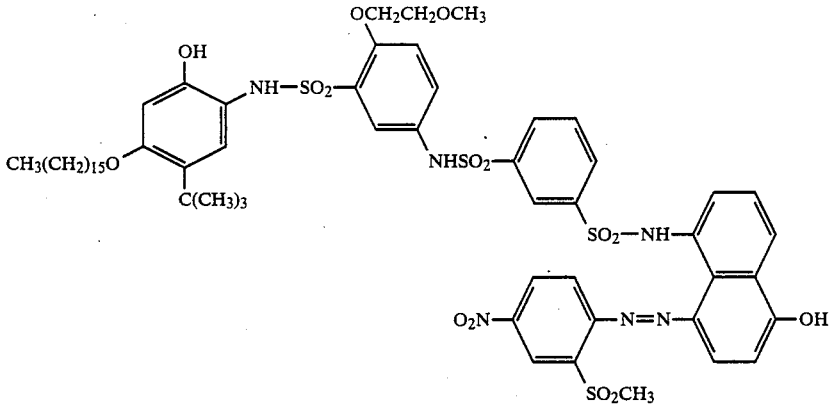

(5) A red-sensitive emulsion layer comprising a red-sensitive internal latent image forming direct positive silver bromide emulsion (as silver 1.03 g/m$^2$), gelatin (1.2 g/m$^2$), the following nucleating agent (0.04 mg/m$^2$) and 2-sulfo-5-n-pentadecylhydroquinone sodium salt (0.13 g/m$^2$).

Nucleating Agent

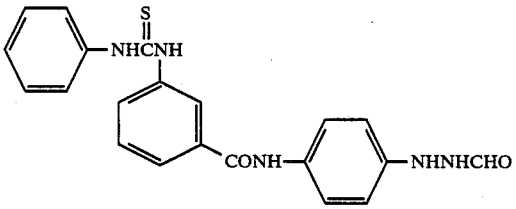

(6) A layer comprising 2,5-di-t-pentadecylhydroquinone (0.43 g/m$^2$), trihexyl phosphate (0.1 g/m$^2$) and gelatin (0.4 g/m$^2$).

(7) A layer comprising a magenta dye releasing redox compound represented by Formula I shown below (0.21 g/m$^2$), a magenta dye releasing redox compound represented by Formula II shown below (0.11 g/m$^2$), tricyclohexyl phosphate (0.08 g/m$^2$), 2,5-di-t-pentadecylhydroquinone (0.009 g/m$^2$) and gelatin (0.9 g/m$^2$).

Formula I

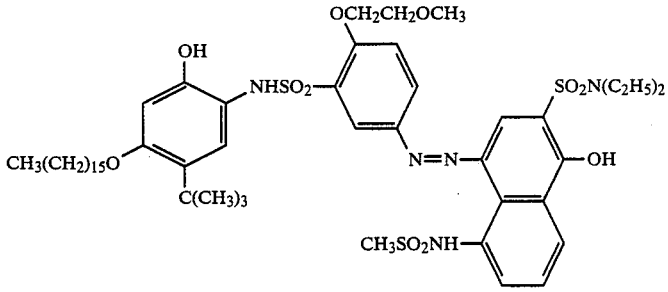

Formula II

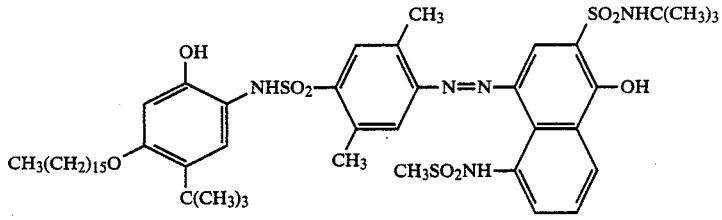

(8) A green-sensitive emulsion layer comprising a green-sensitive internal latent image forming direct positive silver bromide emulsion (as silver 0.82 g/m$^2$, sensitized by Dye A 0.97 mg/m$^2$ and Dye B 1.29 mg/m$^2$), gelatin (0.9 g/m$^2$), the same nucleating agent as in Layer (5) (0.03 mg/m$^2$) and 2-sulfo-5-n-pentadecylhydroquinone sodium salt (0.08 g/m$^2$).

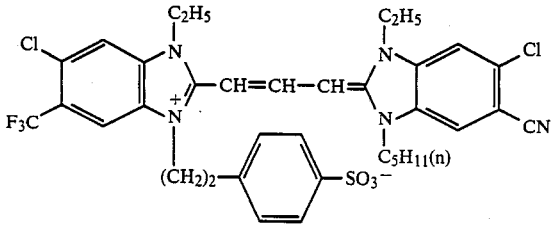

Dye A

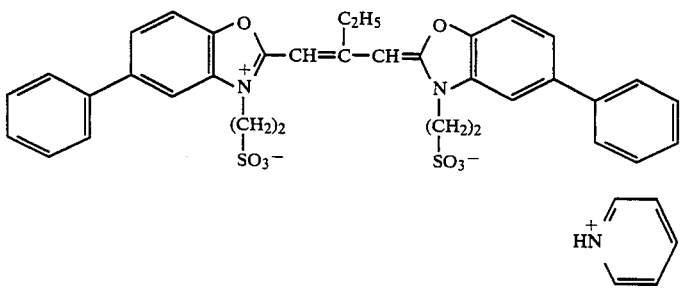

Dye B (9) The same layer as Layer (6)

(10) A layer comprising a yellow dye releasing redox compound shown below (0.53 g/m$^2$), tricyclohexyl phosphate (0.13 g/m$^2$), 2,5-di-t-pentadecylhydroquinone (0.014 g/m$^2$) and gelatin (0.7 g/m$^2$).

Yellow Dye Releasing Redox Compound

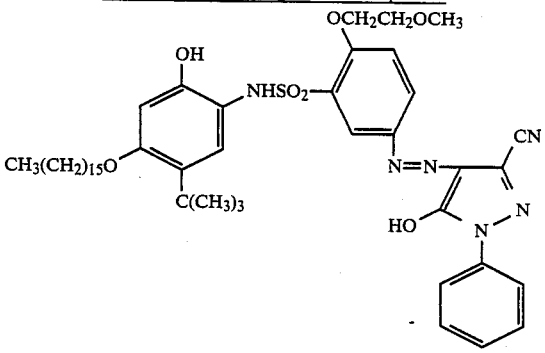

(11) A blue-sensitive emulsion layer comprising a blue-sensitive internal latent image forming direct positive silver bromide emulsion layer (as silver 1.09 g/m$^2$), gelatin (1.1 g/m$^2$), the same nucleating agent as in Layer (5) (0.04 mg/m$^2$) and 2-sulfo-5-n-pentadecylhydroquinone sodium salt (0.07 g/m$^2$).

(12) A layer comprising gelatin (1.0 g/m$^2$).

A sample of the above light-sensitive sheet was exposed through a color test chart. The following viscous developing liquid was spread at 35° C. at a thickness of 85 μm between the light-sensitive sheet and a cover sheet by using a pair of pressure rollers.

| Developing Liquid | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium Sulfite (anhydrous) | 0.2 g |
| Carboxymethyl Cellulose Sodium Salt | 58 g |
| Potassium Hydroxide (28% aq. soln.) | 200 cc |
| Benzyl Alcohol | 1.5 cc |
| Carbon Black | 150 g |

-continued

| Developing Liquid | |
|---|---|
| Water | 685 cc |

As can be seen from the results in Table 4, the compounds according to the present invention increase the maximum density of the red-sensitive layer (R) tremendously and restrain the minimum densities of the green-sensitive (G) and red-sensitive layers. 1-Phenyl-5-mercaptotetrazole used as a reference compound restrains fog but decreases the maximum density. The antifoggant according to the present invention is capable of providing a transfer image having high discrimination.

TABLE 4

| Sample No. | Antifoggant in Cover Sheet | Maximum Density B | Maximum Density G | Maximum Density R | Minimum Density B | Minimum Density G | Minimum Density R |
|---|---|---|---|---|---|---|---|
| A | None | 1.62 | 1.94 | 1.65 | 0.33 | 0.32 | 0.45 |
| B | Compound (1) | 1.69 | 1.99 | 1.92 | 0.33 | 0.28 | 0.40 |
| C | Compound (3) | 1.65 | 1.97 | 1.89 | 0.32 | 0.27 | 0.39 |
| D | Compound (7) | 1.67 | 1.98 | 1.90 | 0.32 | 0.27 | 0.39 |
| E | Compound (15) | 1.68 | 1.99 | 1.91 | 0.33 | 0.28 | 0.40 |
| F | Reference Compound 1-A | 1.23 | 1.61 | 1.60 | 0.28 | 0.26 | 0.40 |

Reference Compound 1-A

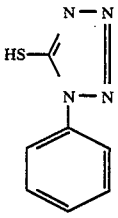

EXAMPLE 5

A multilayered color photographic material was prepared, which was composed of the respective layers of the following compositions on a cellulose triacetate film support.

First Layer: Antihalation Layer

Gelatin layer comprising black colloidal silver

-continued

| | |
|---|---|
| **Second Layer: Intermediate Layer** | |
| Gelatin layer comprising an emulsified dispersion of 2,5-di-t-octylhydroquinone | |
| **Third Layer: First Red-Sensitive Emulsion Layer** | |
| Silver iodobromide emulsion (silver iodide 5 mol %) silver coverage | 1.6 g/m$^2$ |
| Sensitizing Dye I | $4.5 \times 10^{-4}$ mol per mol of silver |
| Sensitizing Dye II | $1.5 \times 10^{-4}$ mol per mol of silver |
| Coupler EX-1 | 0.03 mol per mol of silver |
| Coupler EX-3 | 0.003 mol per mol of silver |
| Coupler EX-4 | 0.0008 mol per mol of silver |
| **Fourth Layer: Second Red-Sensitive Emulsion Layer** | |
| Silver iodobromide emulsion (silver iodide 10 mol %) silver coverage | 1.4 g/m$^2$ |
| Sensitizing Dye I | $3.0 \times 10^{-4}$ mol per mol of silver |
| Sensitizing Dye II | $1.0 \times 10^{-4}$ mol per mol of silver |
| Coupler EX-1 | 0.002 mol per mol of silver |
| Coupler EX-2 | 0.02 mol per mol of silver |
| Coupler EX-3 | 0.0016 mol per mol of silver |
| Coupler EX-4 | $0.8 \times 10^{-4}$ mol per mol of silver |
| **Fifth Layer: Intermediate Layer** | |
| The same as Second Layer | |
| **Sixth Layer: First Green-Sensitive Layer** | |
| Silver iodobromide emulsion (silver iodide 4 mol %) silver coverage | 1.2 g/m$^2$ |
| Sensitizing Dye III | $5.0 \times 10^{-4}$ mol per mol of silver |
| Sensitizing Dye IV | $2.0 \times 10^{-4}$ mol per mol of silver |
| Coupler EX-5 | 0.05 mol per mol of silver |
| Coupler EX-6 | 0.008 mol per mol of silver |
| Coupler EX-7 | 0.0018 mol per mol of silver |
| **Seventh Layer: Second Green-Sensitive Layer** | |
| Silver iodobromide emulsion (silver iodide 8 mol %) silver coverage | 1.3 g/m$^2$ |
| Sensitizing Dye III | $3.0 \times 10^{-4}$ mol per mol of silver |
| Sensitizing Dye IV | $1.2 \times 10^{-4}$ mol per mol of silver |
| Coupler EX-8 | 0.017 mol per mol of silver |
| Coupler EX-5 | 0.003 mol per mol of silver |
| Coupler EX-9 | 0.0004 mol per mol of silver |
| **Eighth Layer: Yellow Filter Layer** | |
| Gelatin layer comprising an emulsified dispersion of yellow colloidal silver and 2,5-di-t-octylhydroquinone | |
| **Ninth Layer: First Blue-Sensitive Emulsion Layer** | |
| Silver iodobromide emulsion (silver iodide 6 mol %) silver coverage | 0.7 g/m$^2$ |
| Coupler EX-10 | 0.25 mol per mol of silver |
| Coupler EX-7 | 0.015 mol per mol of silver |
| **Tenth Layer: Second Blue-Sensitive Layer** | |
| Silver iodobromide emulsion (silver iodide 6 mol %) silver coverage | 0.6 g/m$^2$ |
| Coupler EX-10 | 0.06 mol per mol of silver |
| **Eleventh Layer: First Protective Layer** | |
| Silver iodobromide (silver iodide 1 mol %, average grain diameter: 0.07 μm) silver coverage | 0.5 g/m$^2$ |
| Gelatin | |
| UV Absorber UV-1 (as an emulsified dispersion) | |
| **Twelfth Layer: Second Protective Layer** | |
| Gelatin layer containing polymethyl methacrylate particles (diameter 1.5 μm) | |

In addition to the above compositions, the respective layers further contained a Gelatin Hardener H-1, surfactants, etc. The sample thus prepared was designated as Sample 501.

Samples 502 to 505 were prepared which differed only in that an antifoggant as shown in Table 5 ($2.0 \times 10^{-2}$ mol per mol of colloidal silver) was added in the eighth yellow filter layer.

The above prepared Samples 501 to 505 were subjected to the following accelerating storage condition test to observe a long term natural aging in a short period simulation. The condition of the accelerating test:

(1) Room temperature, 3 days
(2) 50° C., 60% RH, 3 days
(3) 45° C., 80% RH, 3 days After each storage, samples were exposed through an optical wedge and subjected to the following development processing. The sensitometric curves of the green-sensitive layers adjacent the yellow filter layer were determined by automatic density densitometer and the minimum density, Dmin and the relative sensitivity of the green-sensitive layers were shown in Table 5.

The structure of compounds used for the preparation of the samples:

Coupler EX-1

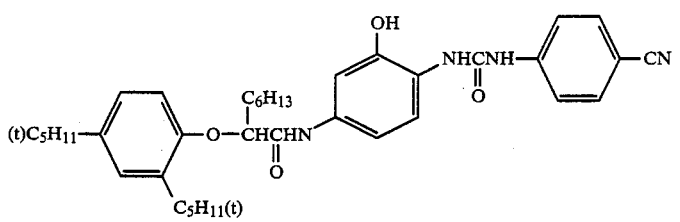

Coupler EX-2

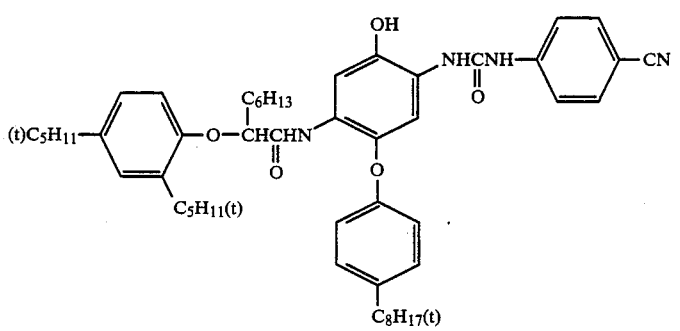

-continued
Coupler EX-3
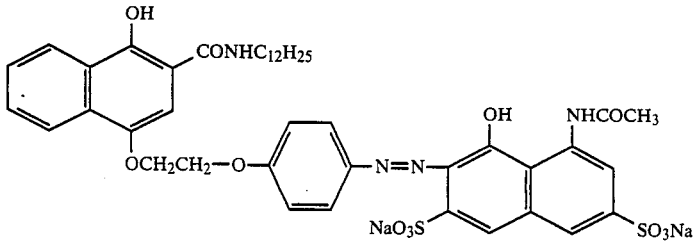
Coupler EX-4
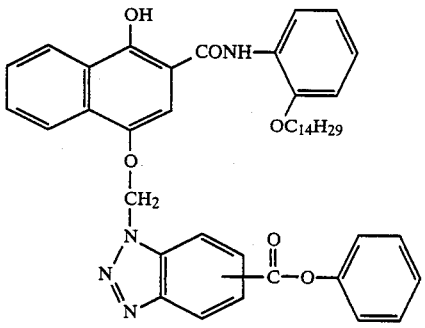
Coupler EX-5
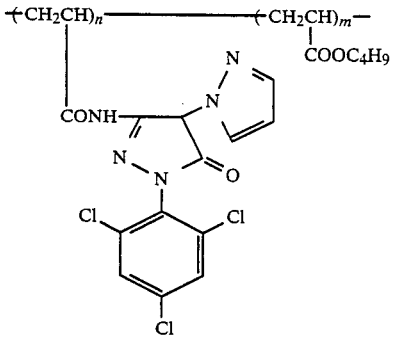
n/m = 1/1 (by wt.)
Coupler EX-6
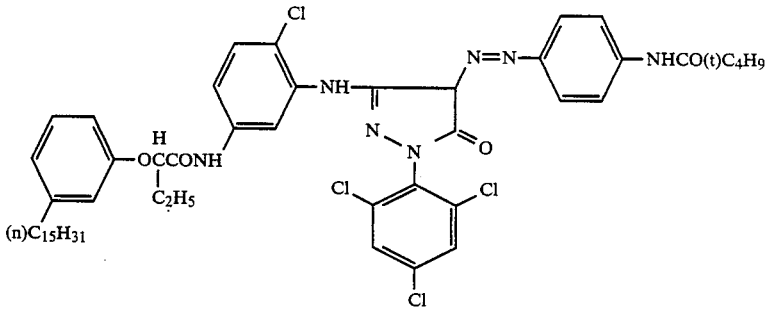
Coupler EX-7
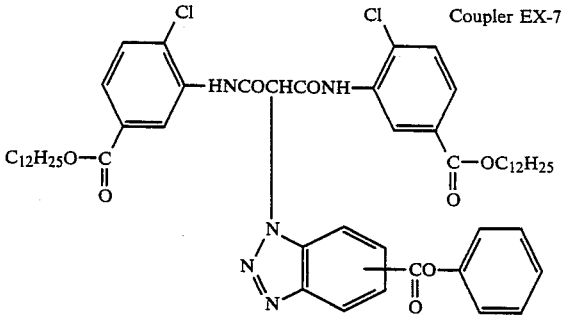
Coupler EX-8
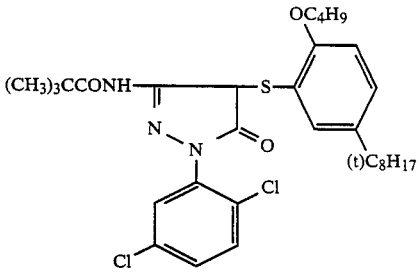
Coupler EX-9
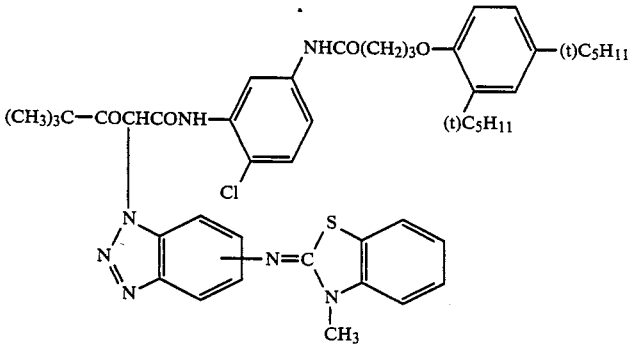

-continued

Coupler EX-10

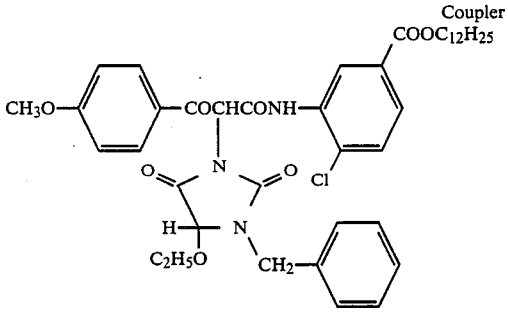

H-1

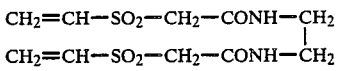

UV-1

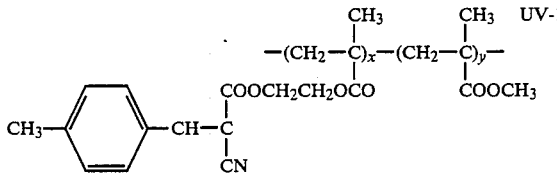

x/y = 7/3 (by wt.)

Sensitizing dye I

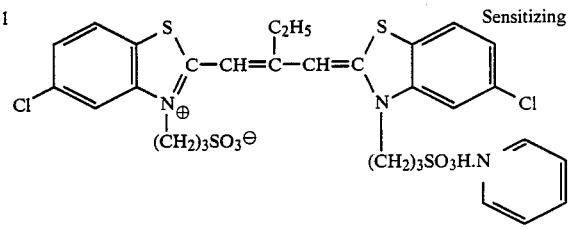

Sensitizing dye II

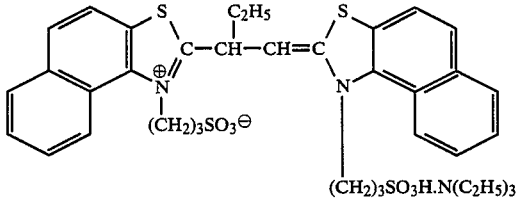

Sensitizing dye III

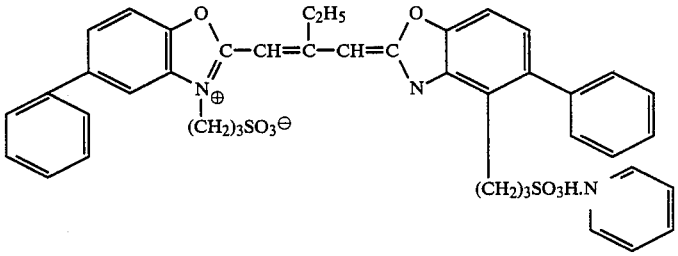

Sensitizing dye IV

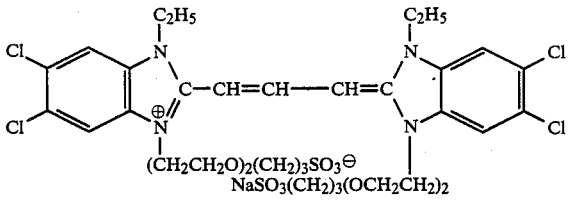

The development processing was carried out at 38° C. in the following manner.

| | |
|---|---|
| 1. Color Development | 3 min 15 sec |
| 2. Bleaching | 6 min 30 sec |
| 3. Washing | 3 min 15 sec |
| 4. Fixing | 6 min 30 sec |
| 5. Washing | 3 min 15 sec |
| 6. Stabilization | 3 min 15 sec |

The processing solution compositions used in the respective steps were as follows:

| | |
|---|---|
| Color Developing Solution | |
| Sodium Nitrilotriacetate | 1.0 g |

-continued

| | |
|---|---|
| Sodium Sulfite | 4.0 g |
| Sodium Carbonate | 30.0 g |
| Potassium Bromide | 1.4 g |
| Hydroxylamine Sulfuric Acid Salt | 2.4 g |
| 4-(N—Ethyl-N—β-hydroxyethylamino)-2-methylaniline Sulfuric Acid Salt | 4.5 g |
| Water to make | 1.0 liter |
| Bleaching Solution | |
| Ammonium Bromide | 160.0 g |
| Ammonia Water (28%) | 25.0 cc |
| Sodium Iron (III) Ethylenediaminetetra-acetate | 130.0 g |
| Glacial Acetic Acid | 14.0 ml |
| Water to make | 1.0 liter |
| Fixing Solution | |
| Sodium Tetrapolyphosphate | 2.0 g |
| Sodium Sulfite | 4.0 g |

-continued

| | |
|---|---|
| Ammonium Thiosulfate (70%) | 175.0 ml |
| Sodium Bisulfate | 4.6 g |
| Water to make | 1.0 liter |
| Stabilizing Solution | |
| Formalin | 8.0 ml |
| Water to make | 1.0 liter |

As can be seen from the results shown in Table 5, Samples 502 to 504 containing an antifoggant according to the present invention provided decreased fog and a small sensitivity decrease, particularly under storage condition No. 3 described above.

TABLE 5

| Sample No. | Antifoggant | $D_{min}$ Green-Sensitive Layer Storage Condition No. 1 | No. 2 | No. 3 | ΔS* Green-Sensitive Layer Storage Condition No. 1 | No. 2 | No. 3 |
|---|---|---|---|---|---|---|---|
| 501 | None | 0.60 | 0.61 | 0.68 | — | +0.02 | −0.18 |
| 502 | Compound (2) | 0.55 | 0.56 | 0.57 | −0.02 | −0.01 | −0.08 |
| 503 | Compound (15) | 0.55 | 0.54 | 0.56 | −0.01 | ±0.00 | −0.06 |
| 504 | Compound (38) | 0.55 | 0.54 | 0.58 | −0.01 | ±0.00 | −0.06 |
| 505 | Reference Compound 5-A | 0.56 | 0.56 | 0.63 | −0.03 | −0.01 | −0.16 |

*Represented as log E difference when the log E corresponding to (fog density + 0.3) of Sample 501 under Condition No. 1 was taken as 0. (— represents changes to lower sensitivity.)

Reference Compound 5-A

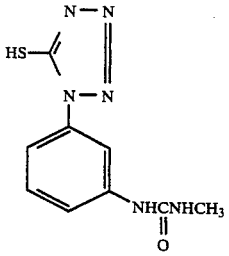

While the invention has been described in detail and with reference to specific embodiments thereof, it will be apparent to one skilled in the art that various changes and modifications can be made therein without departing from the spirit and scope thereof.

What is claimed is:

1. A method of processing a silver halide photographic material comprising processing said silver halide photographic material in the presence of an organic compound which loses its development restraining function by a reduction oxidation reaction with oxidized developers.

2. A method of processing a silver halide photographic material as in claim 1, wherein said organic compound is an antifoggant which possesses a moiety according to the Kendall-Pelz rule and a moiety of either a mercapto group or a cyclic NH group and loses its function to be adsorbed on silver halide grains when converted to an oxidized form by a redox reaction with oxidized developers.

3. A method of processing a silver halide photographic material as in claim 1, wherein said organic compound is represented by the formula (I):

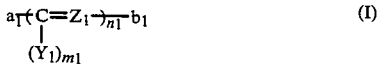

(I)

wherein $a_1$ and $b_1$ each represent a hydroxy group, a group which provides a hydroxy group upon hydrolysis or a substituted or unsubstituted amino group ($Y_1$ can be a substituent of the amino group); $Z_1$ represents

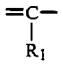

or =N—, in which $R_1$ represents a hydrogen atom or a substituent; $n_1$ represents an integer of 0 to 5; $Y_1$ represents a group having at least one substituent selected from the group consisting of a mercapto group and a cyclic amino group in which the nitrogen is unsubstituted; $m_1$ represents 0 or 1, and when $m_1$ represents 0, the carbon atom to which $Y_1$ is bonded may have another substituent; when $n_1$ represents 0, at least one of $a_1$ and $b_1$ represents an amino group substituted with $Y_1$; when $m_1$ represents 0, at least one of $a_1$ and $b_1$ represents an amino group substituted with $Y_1$; when $n_1$ is 1 and $m_1$ is 0, at least one of $a_1$ and $b_1$ represents an amino group substituted with $Y_1$; when $n_1$ represents an integer of 2 to 5, the repeating unit

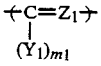

may be the same or different, and may form a single ring or condensed ring, and contain at least one $Y_1$ in the repeating units, or when $Y_1$ is not present in the whole repeating units, at least one of $a_1$ and $b_1$ represents an amino group substituted with $Y_1$.

4. A method of processing a silver halide photographic material as in claim 3, wherein $Y_1$ is represented by formula (II) or (III):

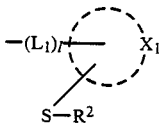

(II)

-continued (III)

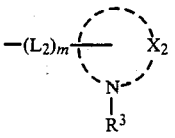

wherein $L_1$ and $L_2$ each represents a linking group, l and m each represents an integer of 0 to 2, $X_1$ and $X_2$ each represents a non-metallic atomic group necessary for forming a 4-membered to 7-membered ring and one or more other rings may be condensed further to the ring above and $L_1$ and $L_2$ can be connected to the condensed ring or rings; $R_2$ and $R_3$ represent a hydrogen atom or a group capable of becoming a hydrogen atom under an alkaline condition.

5. A method of processing a silver halide photographic material as in claim 2, wherein said organic compound possesses a moiety according to the Kendall-Pelz rule which is derived from a compound selected from the group consisting of hydroxylamines, catechols, o-aminophenols, o-phenylenediamines, 2-amino-1-naphthols, ascorbic acids, 1,2-dihydroxynaphthols, α-ketols, α-aminoketones, hydroquinones, p-aminophenols, p-phenylenediamines, 1,4-dihydroxynaphthalenes, 4-amino-1-naphthols, 4,4'-dihydroxybiphenyl, 5-amino-1-naphthols, 1,5-dihydroxynaphthalenes, 3-pyrazolidones and 3-amino-2-pyrazolines.

6. A method of processing a silver halide photographic material as in claim 2, wherein said organic compound possesses a moiety according to the Kendall-Pelz rule which is derived from a compound selected from the group consisting of catechols, o-aminophenols, hydroquinones, p-aminophenols, 1,4-dihydroxynaphthalenes and 4-amino-1-naphthols.

7. A method of processing a silver halide photographic material as in claim 2, wherein said organic compound is incorporated into a silver halide photographic material.

8. A method of processing a silver halide photographic material as in claim 7, wherein said organic compound is a precursor having a blocked mercapto group on a heterocyclic nucleus.

9. A method of processing a silver halide photographic material as in claim 7, wherein said organic compound having a mercapto group on a heterocyclic nucleus is incorporated in an amount of about $10^{-9}$ to $10^{-1}$ mol per mol of silver.

10. A method of processing a silver halide photographic material as in claim 7, wherein said organic compound having a cyclic NH group is incorporated in an amount of about $10^{-8}$ to $10^{-1}$ mol per mol of silver.

11. A method of processing a silver halide photographic material as in claim 1, wherein said organic compound is added to a developing solution as a developing component in an amount of about $10^{-4}$ to 1 mol per liter.

* * * * *